US006102529A

United States Patent [19]

Okazaki et al.

[11] Patent Number: 6,102,529

[45] **Date of Patent: *Aug. 15, 2000**

[54] LIQUID EJECTING METHOD WITH MOVABLE MEMBER

[75] Inventors: Takeshi Okazaki; Makiko Kimura, both of Sagamihara; Toshio Kashino, Chigasaki; Aya Yoshihira; Kiyomitsu Kudo, both of Yokohama; Yoshie Nakata, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/980,208

[22] Filed: Nov. 28, 1997

Related U.S. Application Data

[63] Continuation of application No. 08/638,326, Apr. 26, 1996, abandoned.

[30] Foreign Application Priority Data

Apr. 26, 1995 [JP] Japan ..... 7-127319
May 26, 1995 [JP] Japan ..... 7-128448

[51] Int. Cl.[7] ..... B41J 2/05

[52] U.S. Cl. ..... 347/65; 347/94

[58] Field of Search ..... 347/65, 63, 94

[56] References Cited

U.S. PATENT DOCUMENTS

| | | | |
|---|---|---|---|
| 4,480,259 | 10/1984 | Kruger et al. | 347/63 |
| 4,496,960 | 1/1985 | Fishbeck . | |
| 4,509,063 | 4/1985 | Sugitani et al. . | |
| 4,558,333 | 12/1985 | Sugitani et al. . | |
| 4,568,953 | 2/1986 | Aoki et al. . | |
| 4,611,219 | 9/1986 | Sugitani et al. . | |
| 4,698,645 | 10/1987 | Inamoto . | |
| 4,723,129 | 2/1988 | Endo et al. | 347/56 |
| 4,723,136 | 2/1988 | Suzumura . | |
| 5,262,802 | 11/1993 | Karita et al. . | |
| 5,278,585 | 1/1994 | Karz | 347/65 |
| 5,296,875 | 3/1994 | Suda . | |
| 5,389,957 | 2/1995 | Kimura et al. . | |
| 5,485,184 | 1/1996 | Nakagomi et al. . | |
| 5,485,186 | 1/1996 | Ishinaga | 347/65 |

FOREIGN PATENT DOCUMENTS

| | | | |
|---|---|---|---|
| 0419191 | 3/1991 | European Pat. Off. | B41J 2/05 |
| 0436047 | 7/1991 | European Pat. Off. . | |
| 0443798 | 8/1991 | European Pat. Off. . | |
| 0496533 | 7/1992 | European Pat. Off. . | |
| 0504879 | 9/1992 | European Pat. Off. | B41J 2/05 |
| 0538147 | 4/1993 | European Pat. Off. | B41J 2/195 |

(List continued on next page.)

*Primary Examiner*—John Barlow
*Assistant Examiner*—An H. Do
*Attorney, Agent, or Firm*—Fitzpatrick, Cella, Harper & Scinto

[57] ABSTRACT

A liquid ejecting method for ejecting a liquid comprises using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, and displacing the movable member by a pressure based on generation of the bubble from a position of a reference surface to a position of a maximum displacement, thereby ejecting the liquid, wherein a relation of $2\theta_E-7° \leqq \theta_M \leqq 2\theta_E+7°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

48 Claims, 17 Drawing Sheets

FOREIGN PATENT DOCUMENTS

| | | | |
|---|---|---|---|
| 61-59914 | 2/1980 | Japan . | |
| 55-081172 | 6/1980 | Japan | B41J 3/04 |
| 61-069467 | 4/1986 | Japan | B41J 3/04 |
| 61-110557 | 5/1986 | Japan . | |
| 62-156969 | 7/1987 | Japan . | |
| 62-48585 | 10/1987 | Japan . | |
| 63-197652 | 8/1988 | Japan . | |
| 63-199972 | 8/1988 | Japan | F16K 15/14 |
| 2-113950 | 4/1990 | Japan . | |
| 3-81155 | 4/1991 | Japan . | |
| 5-124189 | 5/1993 | Japan . | |
| 6-31918 | 2/1994 | Japan . | |
| 6-87214 | 3/1994 | Japan . | |

LIQUID EJECTING METHOD WITH MOVABLE MEMBER

This application is a continuation of application Ser. No. 08/638.326 filed Apr. 26, 1996 now abandoned.

BACKGROUND OF THE INVENTION

1. Field of the Invention

The present invention relates to a liquid ejecting head for ejecting a desired liquid, utilizing formation of bubble, a head cartridge using the liquid ejecting head, a liquid ejecting apparatus, a liquid ejecting method, a recording method, and a head used in these methods.

More particularly, the present invention relates to a liquid ejecting method and a recording method using a liquid ejecting head with a movable member arranged to be displaceable making use of generation of bubble.

The present invention is applicable to equipment such as a printer, a copying machine, a facsimile machine having a communication system, a word processor having a printer portion or the like, and an industrial recording device combined with one or more of various processing devices, with which recording is effected on a recording medium such as paper, thread, fiber, textile, leather, metal, plastic material, glass, wood, ceramic material, and so on.

In this specification, "recording" means not only forming an image of letter, figure, or the like having specific meaning, but also forming an image of a pattern having no specific meaning.

2. Related Background Art

A conventionally known ink jet recording method is the one in which a state of ink is changed to cause an instantaneous volume change (generation of bubble), so as to eject the ink through an ejection outlet by acting force resulted from the state change, whereby the ink is deposited on the recording medium to form an image thereon. As disclosed, for example, in U. S. Pat. No. 4,723,129, a recording device using this recording method usually comprises an ejection outlet for ejecting the ink, an ink flow path in fluid communication with the ejection outlet, and an electrothermal transducer as an energy generating means, disposed in the ink flow path, for ejecting the ink.

By this recording method a high quality image can be recorded at high speed and with low noise and such ejection outlets for ejecting the ink may be arranged in high density in a head for performing this recording method. Therefore, the recording method has a lot of excellent points; for example, the device compact in size can obtain an image recorded in high resolution and can also readily obtain a color image. Because of it, the ink jet recording method is now widely used in printers, copying machines, facsimile machines, or other office equipment, and even in industrial systems such as a textile printing device or the like.

With spread of use of the ink jet technology in products in wide fields, a variety of demands described below are increasing these years.

For example, an example of investigation to meet the demand to improve the energy use efficiency is optimization of the heat generating element such as adjustment of the thickness of a protection film. This technique is effective to an improvement in transfer efficiency of heat generated into the liquid.

In order to provide high-quality images, proposed were driving conditions for realizing the liquid ejection method or the like capable of performing good ink ejection based on high-speed ejection of ink and stable generation of bubble. From the standpoint of high-speed recording, proposed was an improvement in a configuration of flow passage in order to obtain a liquid ejecting head with high filling (refilling) speed of the liquid ejected, into the liquid flow path.

Among this configuration of liquid passage, the publication of Japanese Laid-open Patent Application No. 63-199972 or the like describes the flow passage structure as shown in FIGS. 1A and 1B. The flow passage structure and the head producing method described in this publication concern the invention accomplished noting the back wave occurring with generation of bubble (i.e., the pressure directed in the opposite direction to the direction toward the ejection outlet, which is the pressure directed to a liquid chamber 12). This back wave is known as loss energy, because it is not energy directed in the ejection direction.

The invention shown in FIGS. 1A and 1B discloses a valve 10 located apart from a bubble generation region formed by a heat generating element 2 and on the opposite side to the ejection outlet 11 with respect to the heat generating element 2.

In FIG. 1B, this valve 10 is illustrated as being produced by the producing method making use of a plate material or the like, having an initial position where it is stuck to the ceiling of the flow path 3, and dropping into the flow path 3 with generation of bubble. This invention is disclosed as the one for suppressing the energy losses by controlling a part of the back wave by the valve 10.

However, as apparent from investigation on the case where a bubble is generated inside the flow path 3 as retaining the liquid to be ejected in this structure, to regulate a part of the back wave by the valve 10 is not practical for ejection of liquid.

The back wave itself originally has no direct relation with ejection, as discussed previously. At the point when the back wave appears in the flow path 3, as shown in FIG. 1B, the pressure directly related to ejection out of the bubble is already ready to eject the liquid from the flow path 3. It is thus clear that to regulate the back wave, more accurately, to regulate a part thereof, cannot give a great effect on ejection.

In the bubble jet recording method utilizing the bubble generated by the heat generating element, on the other hand, heating is repeated while the heat generating element is in contact with the ink, which forms a deposit due to scorch of ink on the surface of the heat generating element. A large amount of the deposit could be formed depending upon the type of ink, which could result in unstable generation of bubble and which could make it difficult to eject the ink in good order. It has been desired to achieve a method for well ejecting the liquid without changing the property of the liquid to be ejected even if the liquid to be ejected is the one easily deteriorated by heat or even if the liquid is the one not easy to achieve adequate generation of bubble.

From this viewpoint, another proposal was made to provide a method to employ different types of liquids, a liquid (bubble generation liquid) for generating a bubble by heat and a liquid (ejection liquid) to be ejected, arranged to transmit the pressure upon generation of bubble to the ejection liquid and to eject the ejection liquid thereby, for example as disclosed in Japanese Laid-open Patent Applications No. 61-69467 and No. 55-81172, U. S. Pat. No. 4,480,259, and so on. In these publications, the ink as the ejection liquid is perfectly separated from the bubble generation liquid by a flexible film such as silicone rubber so as to keep the ejection liquid from directly contacting the heat generating element, and the pressure upon generation of bubble in the bubble generation liquid is transferred to the ejection liquid through deformation of the flexible film. By this structure, the method achieved prevention of the deposit on the surface of the heat generating element, an improvement in freedom of selection of the ejection liquid, and so on.

SUMMARY OF THE INVENTION

The present invention provides a novel ejecting method capable of achieving basic ejecting properties which have never been achieved by the fundamentally conventional methods arranged to eject the liquid as forming a bubble (especially, a bubble caused by film boiling) in a liquid flow path.

The present invention provides a liquid ejecting condition that is effective to adequately respond to a dispersion factor in an ejection outlet portion, which has been unsolved by the conventional liquid ejecting principle, and that can achieve an excellent ejection efficiency. Particularly, the present invention provides a liquid ejecting method effective to the dispersion factor in producing a plurality of such ejection outlet portions.

Further, the present invention also provides a liquid ejecting head that can realize more certain and more reliable effects of the ejecting method according to the present invention.

This head according to the present invention is the one obtained by technically developing the knowledge gained in a prior application, based on a new standpoint. The summary of this prior application is given in the following.

As disclosed in the prior application, a movable member is provided in a flow path, and the fulcrum and free end of the movable member are arranged in such a positional relation that the free end is located on the ejection outlet side, that is, on the downstream side. Further, the movable member is arranged to face a heat generating element or a bubble generation region. This established the utterly novel technology that the bubble is positively controlled by this arrangement.

Next, it was found that, considering the energy given to ejection by the bubble itself, a maximum factor to considerably improve the ejection properties was to take account of a downstream growing component of the bubble. Namely, it was also clarified that the ejection efficiency and ejection rate were improved by effectively aligning the direction of the downstream growing component of the bubble with the ejection direction. This led some of the present inventors to an extremely high technical level, as compared with the conventional technical level, that the downstream growing component of the bubble is positively moved to the free end side of the movable member.

Further, it was found that it was also preferred to take account of structural elements such as the movable member, the liquid flow path, and so on related to growth of bubble on the downstream side in the heating region for forming the bubble, for example, on the downstream side from the center line passing the center of the area of the electrothermal transducer in the direction of flow of liquid or on the downstream side from the center of the area of a surface contributing to bubble generation.

It was further found that the refilling rate was able to be greatly improved taking account of the location of the movable member and the structure of the liquid supply passage.

In particular, the present invention was accomplished noting that variations in an ejection state occurred because of a dispersion factor in manufacturing the configuration of ejection outlet. Then the inventors finally derived the epoch-making technology to stabilize the ejection state as further improving the ejection efficiency of liquid by taking account of a relationship between a displacement angle of the movable member and an angle of a line connecting a fulcrum portion of the movable member with an intersecting point of a center axis of an ejection outlet with a surface (connection surface) of an ejection outlet portion connected to a liquid flow path and as also utilizing the epoch-making liquid ejection method and principle in the prior application.

Main objects of the present invention are as follows.

A first object of the present invention is to provide a liquid ejecting method, a liquid ejecting head, and so on that can achieve a more stabilized ejection state by maintaining in a predetermined range, with respect to the reference at a position of a reference surface of the movable member, the relationship between the angle of the axis connecting the fulcrum portion of the movable member with the intersecting point of the center axis of the ejection outlet with the surface of the ejection outlet portion connected to the liquid flow path and the displacement angle upon maximum displacement of the movable member provided with the free end for controlling a bubble generated (the angle of maximum displacement).

A second object of the present invention is to provide a liquid ejecting method, a liquid ejecting head, and so on that can largely decrease accumulation of heat in the liquid above the heat generating element as improving the ejection efficiency and ejection force in addition to the first object and that can perform good liquid ejection by decreasing residual bubbles above the heat generating element.

A third object of the present invention is to provide a liquid ejecting head etc. enhanced in refilling frequency and improved in print speed or the like by suppressing the action of inertial force in the opposite direction to the liquid supply direction due to the back wave and decreasing a meniscus back amount by a valve function of the movable member.

Additionally, a fourth object of the present invention is to provide a liquid ejecting method, a liquid ejecting head, and so on that reduces a deposit on the heat generating element, that can broaden the application range of the ejection liquid, and that can demonstrate considerably high ejection efficiency and ejection force.

A fifth object of the present invention is to provide a liquid ejecting method, a liquid ejecting head, and so on having increased degrees of freedom of selection of the liquid to be ejected.

Typical features of the present invention for achieving the above objects are as follows.

According to an aspect of the present invention, there is provided a liquid ejecting method for ejecting a liquid, comprising:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, and displacing the movable member by a pressure based on generation of the bubble from a position of a reference surface to a position of a maximum displacement, thereby ejecting the liquid, wherein a relation of $2\theta_E-5° \leqq \theta_M \leqq 2\theta_E+5°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting method comprising:

using a liquid ejecting head having an ejection outlet portion having an ejection outlet for ejecting a liquid, a first liquid flow path in fluid communication with the ejection outlet portion, a second liquid flow path having a bubble generation region, and a movable member disposed to face the bubble generation region and provided with a free end closer to the ejection outlet portion than a fulcrum portion thereof, generating a bubble in the bubble generation region, and displacing the movable member by a pressure based on generation of the bubble from a position of a reference surface to a position of a maximum displacement, thereby ejecting the liquid, wherein a relation of $2\theta_E-5° \leqq \theta_M \leqq 2\theta_E+5°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting method for ejecting a liquid, comprising:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, and displacing the movable member by a pressure based on generation of the bubble from a position of a reference surface to a position of a maximum displacement, thereby ejecting the liquid, wherein a relation of $2\theta_E-7° \leqq \theta_M \leqq 2\theta_E+7°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting method comprising:

using a liquid ejecting head having an ejection outlet portion having an ejection outlet for ejecting a liquid, a first liquid flow path in fluid communication with the ejection outlet portion, a second liquid flow path having a bubble generation region, and a movable member disposed to face the bubble generation region and provided with a free end closer to the ejection outlet portion than a fulcrum portion thereof, generating a bubble in the bubble generation region, and displacing the movable member by a pressure based on generation of the bubble from a position of a reference surface to a position of a maximum displacement, thereby ejecting the liquid, wherein a relation of $2\theta_E-7° \leqq \theta_M \leqq 2\theta_E+7°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting method for ejecting a liquid, comprising:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, and displacing the movable member by a pressure based on generation of the bubble from a position of a reference surface to a position of a maximum displacement, thereby ejecting the liquid, wherein a relation of $\theta_M \leqq 2\theta_E+5°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle and is not less than an angle of an axis connecting the fulcrum portion with an uppermost end of the ejection outlet portion of the connecting surface.

According to another aspect of the present invention, there is provided a liquid ejecting method for ejecting a liquid, comprising:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, and displacing the movable member by a pressure based on generation of the bubble from a position of a reference surface to a position of a maximum displacement, thereby ejecting the liquid, wherein a relation of $2\theta_E-5° \leqq \theta_M \leqq 2\theta_E$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle and is not less than an angle of an axis connecting the fulcrum portion with an uppermost end of the ejection outlet portion of the connecting surface.

According to another aspect of the present invention, there is provided a liquid ejecting head for ejecting a liquid, comprising:

an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, wherein, upon displacing the movable member by a pressure based on generation of the bubble from a position of a reference surface to a position of a maximum displacement to eject the liquid, a relation of $2\theta_E-5° \leqq \theta_M \leqq 2\theta_E+5°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting head comprising:

an ejection outlet portion having an ejection outlet for ejecting a liquid, a first liquid flow path in fluid communication with the ejection outlet portion, a second liquid flow path having a bubble generation region, and a movable member disposed to face the bubble generation region and provided with a free end closer to the ejection outlet portion than a fulcrum portion thereof, wherein, upon generating a bubble in the bubble generation region and displacing the movable member by a pressure based on the generation of the bubble from a position of a reference surface to a position of a maximum displacement to eject the liquid, a relation of $2\theta_E-5° \leqq \theta_M \leqq 2\theta_E+5°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting head for ejecting a liquid, comprising:

an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, wherein, upon displacing the movable member by a pressure based on generation of the bubble from a position of a reference surface to a position of a maximum displacement to eject the liquid, a relation of $2\theta_E-7° \leqq \theta_M \leqq 2\theta_E+7°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting head comprising:

an ejection outlet portion having an ejection outlet for ejecting a liquid, a first liquid flow path in fluid communication with the ejection outlet portion, a second liquid flow path having a bubble generation region, and a movable member disposed to face the bubble generation region and provided with a free end closer to the ejection outlet portion than a fulcrum portion thereof, wherein, upon generating a bubble in the bubble generation region and displacing the movable member by a pressure based on the generation of the bubble from a position of a reference surface to a position of a maximum displacement to eject the liquid, a relation of $2\theta_E-7° \leqq \theta_M \leqq 2\theta_E+7°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle.

According to another aspect of the present invention, there is provided a liquid ejecting head for ejecting a liquid, comprising:

an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, in which the movable member is displaced by a pressure based on generation of a bubble from a position of a reference surface to a position of a maximum displacement to eject the liquid, wherein a relation of $\theta_M \leqq 2\theta_E+5°$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle and is not less than an angle of an axis connecting the fulcrum portion with an uppermost end of the ejection outlet portion of the connecting surface.

According to another aspect of the present invention, there is provided a liquid ejecting head for ejecting a liquid, comprising:

an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to the ejection outlet portion than a fulcrum portion thereof, in which the movable member is displaced by a pressure based on generation of a bubble from a position of a reference surface to a position of a maximum displacement to eject the liquid, wherein a relation of $2\theta_E-5° \leqq \theta_M \leqq 2\theta_E$ is satisfied where, with a reference of the reference surface, $\theta_M$ is an angle of the movable member at the maximum displacement thereof about the fulcrum portion and $\theta_E$ is an angle of an axis connecting the fulcrum portion with an intersecting point of a center axis of the ejection outlet with a connecting surface of the ejection outlet portion to the liquid flow path, and wherein $\theta_M$ is an acute angle and is not less than an angle of an axis connecting the fulcrum portion with an uppermost end of the ejection outlet portion of the connecting surface.

According to another aspect of the present invention, there is provided a liquid ejecting apparatus having the liquid ejecting head as described in either one of the above aspects, and driving signal supply means for supplying a driving signal for ejecting the liquid from the liquid ejecting head.

According to another aspect of the present invention, there is provided a liquid ejecting apparatus having the liquid ejecting head as described in either one of the above aspects, and recording medium conveying means for conveying a recording medium for receiving the liquid ejected from the liquid ejecting head.

According to the present invention, the ejection state of the liquid was able to be stabilized by properly defining the maximum displacement angle at the time when the movable member for controlling the bubble generated is displaced at maximum by generation of bubble, with respect to the angle of the line connecting the fulcrum portion of the movable member with the intersecting point of the center axis of ejection port or the area center axis with the surface of the ejection outlet portion connected to the liquid flow path.

In addition, the liquid ejecting method, head, and so on according to the present invention, based on the very novel ejection principle, can attain the synergistic effect of the bubble generated and the movable member displaced thereby, so that the liquid near the ejection outlet can be efficiently ejected, thereby improving the ejection efficiency as compared with the conventional ejection methods, heads, and so on of the ink jet method. For example, the most preferable form of the present invention achieved a quantum leap of ejection efficiency two or more times improved.

With the characteristic structures of the present invention, ejection failure can be prevented even after long-term storage at low temperature or at low moisture, or, even if ejection failure occurs, the head can be advantageously returned instantaneously into a normal condition only with a recovery process such as preliminary ejection or suction recovery.

Specifically, under the long-term storage condition to cause ejection failure of almost all of ejection outlets in the head of the conventional ink jet method having sixty four ejection outlets, the head of the present invention showed ejection failure only in approximately half or less of the ejection outlets. For recovering these heads by preliminarily ejection, several thousand preliminary ejections were required for each ejection outlet in the conventional head, whereas a hundred or so preliminarily ejections were sufficient to recover the head of the present invention. This means that the present invention can shorten the recovery period, can decrease losses of the liquid due to recovery, and can greatly lower the running cost.

Particularly, the structures for improving the refilling characteristics of the present invention achieved high responsivity upon continuous ejection, stable growth of bubble, and stabilization of liquid droplet and realized high-speed recording or high-quality recording based on the high-speed liquid ejection.

The other effects of the present invention will be understood from the description of the embodiments.

In the specification, the terms "upstream" and "downstream" are defined with respect to a general liquid flow from a liquid supply source through the bubble generation region (or the movable member) to the ejection outlet or are expressed as expressions as to the direction in this structure.

Further, a "downstream side" portion of the bubble itself represents an ejection-outlet-side portion of the bubble which directly functions mainly to eject a liquid droplet. More particularly, it means a downstream portion of the bubble in the above flow direction or in the direction of the above structure with respect to the center of the bubble, or a bubble appearing in the downstream region from the center of the area of the heat generating element.

In this specification, a "substantially sealed" state generally means a sealed state in such a degree that, when a bubble grows, the bubble does not escape through a gap (slit) around the movable member before motion of the movable member.

In this specification, a "partition wall" may mean a wall (which may include the movable member) interposed to separate the region in direct fluid communication with the ejection outlet from the bubble generation region in a wide sense, and more specifically means a wall separating the liquid flow path including the bubble generation region from the liquid flow path in direct fluid communication with the ejection outlet, thereby preventing mixture of the liquids in the respective liquid flow paths in a narrow sense.

In the specification, a "free end portion" of the movable member means a portion including the free end, which is a downstream-side end of the movable member, and neighboring regions, and also including a portion near the downstream corners of the movable member.

Further, a "free end region" of the movable member means the free end itself at the downstream-side end of the movable member, a region including the side ends of the free end, or a region including both the free end and the side ends.

Further, the "fulcrum portion" of the movable member stated herein means a border portion between a displacing portion of the movable member and a portion substantially not displaced; for example, in the case of the movable member being formed by a slit in the partition wall, it corresponds to the end of the cut of slit, which is the position of the root of the movable member.

Further, the "reference surface" stated herein means a surface including the movable member 31 kept in a natural state without being displaced as being free from the external force. This is substantially equivalent to defining the reference surface as a plane including the fulcrum of the movable member and connecting the partition wall extending on the downstream side from the fulcrum to the ejection outlet with the partition wall extending on the upstream side opposite thereto. If the movable member is deformed, the latter can be used as the reference surface.

Further, the "displacement angle" of the movable member stated herein means an angle around the center of rotation at the fulcrum portion, of the straight line connecting the above-mentioned fulcrum portion with the free end upon displacement of the movable member, with respect to the reference of the aforementioned reference surface. Especially, the maximum of this displacement angle is defined as a maximum displacement angle $\theta_M$.

Further, the "center axis of ejection outlet" means a rotational axis of cylinder in the case of a cylindrical ejection outlet portion or a straight line connecting the center of circle of the aperture of the ejection outlet portion on the liquid flow path side (ejection outlet 18) with the center of circle of the ejection outlet portion on the outer surface (face surface) side.

If the ejection outlet portion is not circular, the "center axis of ejection outlet" or the "center axis of the area of ejection outlet" is defined as a straight line connecting the center of the area on the liquid flow path side with the center of the area on the face surface side.

Figure 1A:
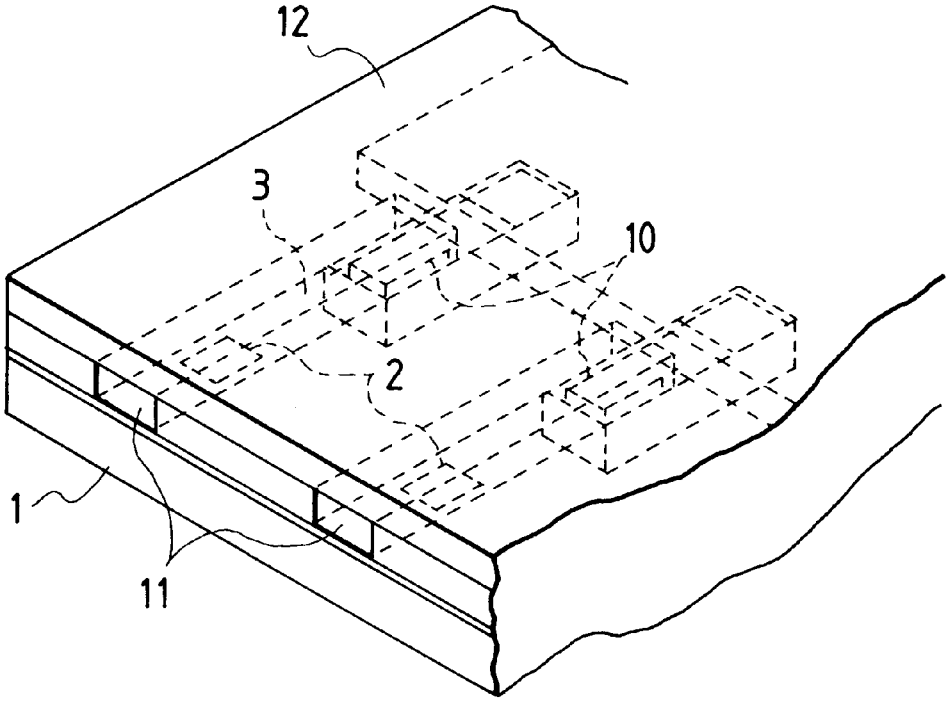
FIG. 1A PRIOR ART
FIGS. 1A and 1B are a perspective view of a conventional liquid ejecting head and a sectional view of a liquid flow path of the conventional liquid ejecting head.
Figure 1B:
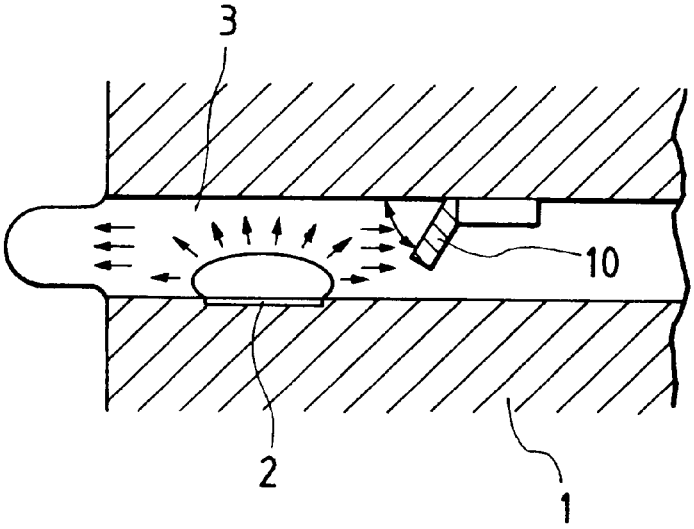
FIG. 1B PRIOR ART

DESCRIPTION OF THE PREFERRED EMBODIMENTS (Description of principle)

The principle of ejection applicable to the present invention will be explained referring to the drawings.

Figure 2A:
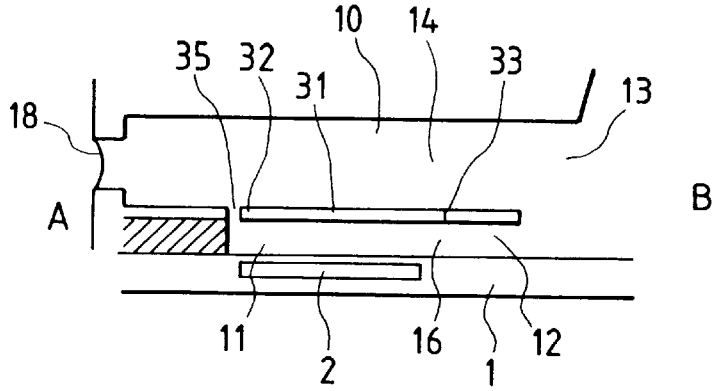
FIGS. 2A, 2B, 2C, and 2D are schematic sectional views of an example of a liquid ejecting head applied to the present invention.
Figure 2B:
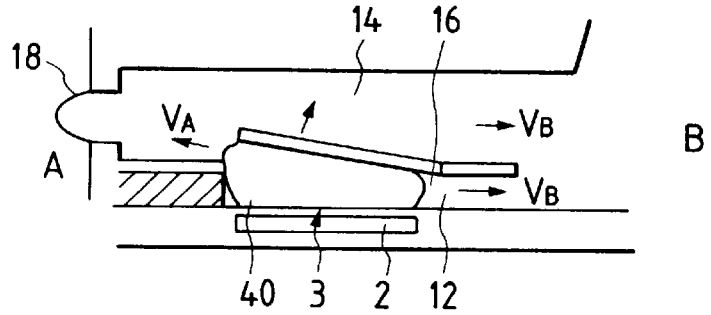
Figure 2C:
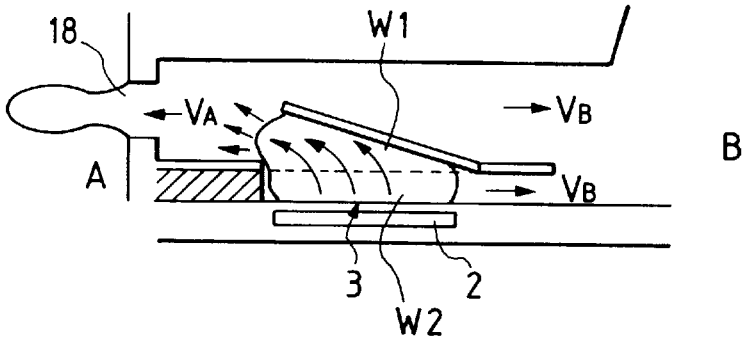
Figure 2D:
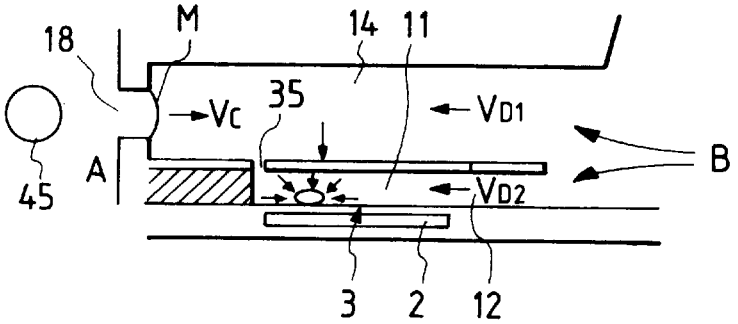
Figure 3:
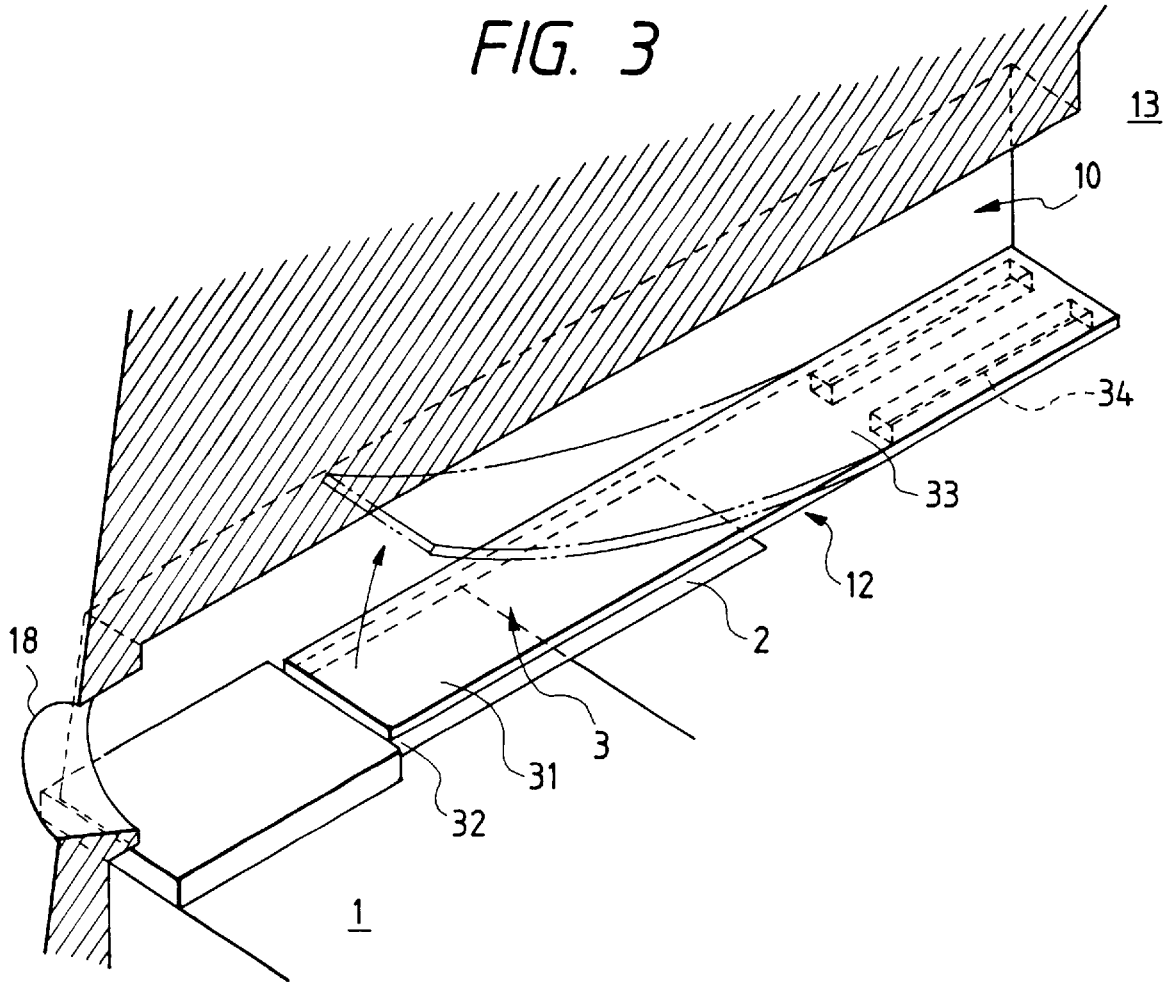
FIG. 3 is a partly broken perspective view of a liquid ejecting head applied to the present invention.

FIGS. 2A to 2D are schematic sectional views of a liquid ejecting head, cut along the direction of the liquid flow path, and FIG. 3 is a partly broken, perspective view of the liquid ejecting head.

The liquid ejecting head of FIGS. 2A to 2D comprises an element substrate 1, a heat generating element 2 (a heat generating resistor in the configuration of 40 $\mu$m×105 $\mu$m in FIG. 3) as an ejection energy generating element for supplying thermal energy to the liquid to eject the liquid, mounted on the element substrate 1, and a liquid flow path 10 formed above the element substrate in correspondence to the heat generating element 2. The liquid flow path 10 is in fluid communication with an ejection outlet 18 and with a common liquid chamber 13 for supplying the liquid to a plurality of such liquid flow paths 10, so that the liquid flow path 10 receives the liquid in an amount equivalent to the liquid having been ejected through the ejection outlet from the common liquid chamber 13.

Above the element substrate and in the liquid flow path 10 a movable member 31 of a plate shape having a flat portion is formed in a cantilever form and of a material having elasticity, such as a metal, so as to face the above-mentioned heat generating element 2. One end of the movable member is fixed to a foundation (support member) 34 or the like provided by patterning of a photosensitive resin on the wall of the liquid flow path 10 or on the element substrate. This structure supports the movable member and constitutes a fulcrum (fulcrum portion) 33.

This movable member 31 has the fulcrum (fulcrum portion: fixed end) 33 on the upstream side of a large flow of the liquid from the common liquid chamber 13 through the movable member 31 toward the ejection outlet 18, caused by the ejection operation of the liquid, and has a free end (free end portion) 32 on the downstream side with respect to this fulcrum 33. The movable member 31 is so positioned that it is opposed to the heat generating element 2 with a gap of approximately 15 $\mu$m therefrom so as to cover the heat generating element 2. A bubble generation region is defined between the heat generating element and the movable member. The type, configuration, and position of the heat generating element or the movable member are not limited to those described above, but may be arbitrarily changed as long as the configuration and position are suitable for controlling the growth of bubble and propagation of pressure as discussed below. For the convenience' sake of description of the flow of the liquid discussed hereinafter, the liquid flow path 10 as described is divided by the movable member 31 into two regions, i.e., a first liquid flow path 14 in direct communication with the ejection outlet 18 and a second liquid flow path 16 having the bubble generation region 11 and the liquid supply passage 12.

Heating the heat generating element 2, heat is applied to the liquid in the bubble generation region 11 between the movable member 31 and the heat generating element 2, whereby a bubble is generated in the liquid by the film boiling phenomenon as described in the specification of U.S. Pat. No. 4,723,129. The bubble and the pressure raised by the generation of bubble mainly act on the movable member, so that the movable member 31 is displaced to widely open on the ejection outlet side about the fulcrum 33, as shown in FIGS. 2B and 2C or FIG. 3. The displacement or the displaced state of the movable member 31 guides the growth of the bubble itself or the propagation of the pressure raised with generation of the bubble toward the ejection outlet.

Here, one of the fundamental ejection principles applied to the present invention will be explained. One of the most importance principles in the present invention is that with the pressure of the bubble or the bubble itself the movable member disposed to face the bubble is displaced from a first position in a stationary state to a second position in a state after displaced and the movable member 31 thus displaced guides the bubble itself or the pressure caused by the generation of bubble toward the downstream side where the ejection outlet 18 is positioned.

Figure 4:
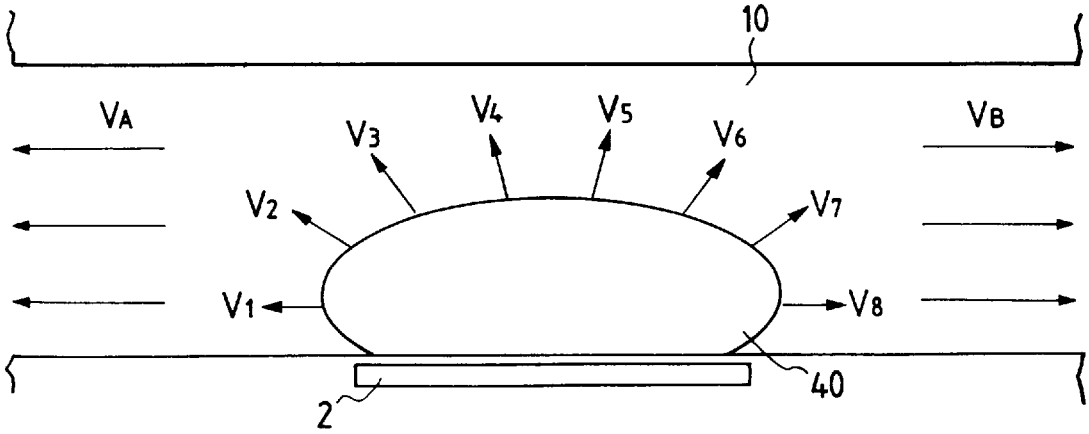
FIG. 4 PRIOR ART
FIG. 4 is a schematic view of pressure propagation from a bubble in a conventional head.
Figure 5:
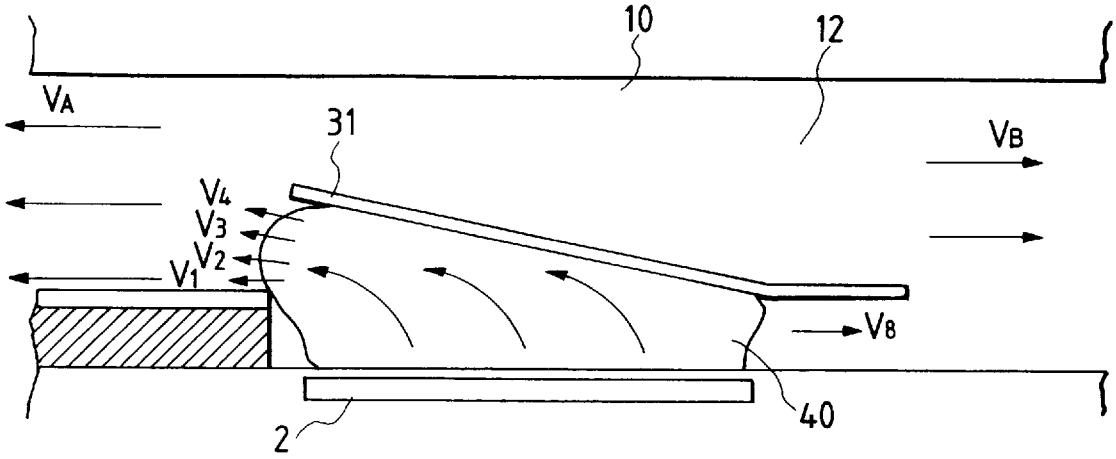
FIG. 5 is a schematic view of pressure propagation from a bubble in a head applied to the present invention.

This principle will be explained as comparing FIG. 5 showing the present invention with FIG. 4 schematically showing the conventional liquid flow path structure using no movable member. Here, $V_A$ represents the direction of propagation of the pressure toward the ejection outlet while $V_B$ the direction of propagation of the pressure toward the upstream.

The conventional head shown in FIG. 4 has no structure for regulating directions of propagation of the pressure raised by the bubble 40 generated. Thus, the pressure of the bubble 40 propagates in various directions normal to the surface of the bubble as shown by V1–V8. Among these, components having the pressure propagation directions along the direction $V_A$ most effective to the liquid ejection are those having the directions of propagation of the pressure in the portion of the bubble closer to the ejection outlet than the nearly half point, i.e., V1–V4, which is an important portion directly contributing to the liquid ejection efficiency, the liquid ejection force, the ejection speed, and so on. Further, V1 effectively acts because being closest to the ejection direction $V_A$, and, contrary thereto, V4 involves a relatively small component directed in the direction of $V_A$.

In contrast with it, in the case of the present invention shown in FIG. 5, the movable member 31 works to guide the pressure propagation directions V1–V4 of bubble, otherwise directed in the various directions in the case of FIG. 4, toward the downstream side (the ejection outlet side) so as to change them into the pressure propagation direction of $V_A$, thereby making the pressure of bubble 40 contribute directly and effectively to ejection.

The growing direction itself of bubble is guided to the downstream in the same manner as the pressure propagation directions V1–V4 are, so that the bubble grows more on the downstream side than on the upstream side. In this manner, the ejection efficiency, the ejection force, the ejection speed, and so on can be fundamentally improved by controlling the growing direction itself of bubble by the movable member and controlling the pressure propagation directions of bubble.

Now returning to FIGS. 2A to 2D, the ejection operation of the liquid ejecting head stated above will be described in detail.

FIG. 2A shows a state before the energy such as electric energy is applied to the heat generating element 2, which is, therefore, a state before the heat generating element generates the heat. An important point is that the movable member 31 is positioned relative to the bubble generated by heat generation of the heat generating element so as to be opposed to at least the downstream side portion of the bubble. Namely, in order to let the downstream portion of the bubble act on the movable member, the liquid flow passage structure is arranged in such a way that the movable member 31 extends at least up to a position downstream of the center 3 of the area of the heat generating element (or downstream of a line passing through the center 3 of the area of the heat generating element and being perpendicular to the lengthwise direction of the flow path).

FIG. 2B shows a state in which the electric energy or the like is applied to the heat generating element 2 to heat the heat generating element 2 and the heat thus generated heats a part of the liquid filling inside of the bubble generation region 11 to generate a bubble in accordance with film boiling.

At this time the movable member 31 is displaced from the first position to the second position by the pressure raised by generation of bubble 40 so as to guide the propagation directions of the pressure of the bubble into the direction toward the ejection outlet. An important point here is, as described above, that the free end 32 of the movable member is located on the downstream side (or on the ejection outlet side) while the fulcrum 33 on the upstream side (or on the common liquid chamber side) so that at least a part of the movable member may be opposed to the downstream portion of the heat generating element, that is, to the downstream portion of the bubble.

FIG. 2C shows a state in which the bubble 40 has further grown and the movable member 31 is further displaced according to the pressure raised by generation of bubble 40. The bubble generated grows more downstream than upstream to expand largely beyond the first position (the position of the dotted line) of the movable member.

It is thus understood that a gradual displacement of the movable member 31 in response to the growth of bubble 40 allows the pressure propagation directions of bubble 40 to be uniformly directed toward the ejection outlet and allows the bubble to grow in a direction in which the volume can be readily changed, i.e., in the direction toward the free end, thereby also increasing the ejection efficiency. When the movable member guides the bubble and the bubble generation pressure toward the ejection outlet, it rarely obstructs the propagation and growth and can efficiently control the propagation directions of the pressure and the growth direction of the bubble in accordance with the magnitude of the pressure propagating.

FIG. 2D shows a state in which the bubble 40 contracts and extincts because of a decrease of the pressure inside the bubble after the film boiling stated previously.

The movable member 31 having been displaced to the second position returns to the initial position (the first position) of FIG. 2A by restoring force resulting from the spring property of the movable member itself and the negative pressure due to the contraction of the bubble. Upon collapse of the bubble the liquid flows into the bubble generation region 11 in order to compensate for the volume reduction of the bubble and in order to compensate for the volume of the liquid ejected, as indicated by the flows $V_{D1}$, $V_{D2}$ from the upstream side (B) or the common liquid chamber side and by the flow $V_c$ from the ejection outlet side.

The foregoing explained the operation of the movable member with generation of the bubble and the ejecting operation of the liquid, and then the following explains refilling of the liquid in the liquid ejecting head, applicable to the present invention.

After FIG. 2C, the bubble 40 experiences a state of the maximum volume and enters a bubble collapsing process. In the bubble collapsing process, a volume of the liquid enough to compensate for the volume of the bubble having collapsed flows into the bubble generation region from the ejection outlet side of the first liquid flow path 14 and from the side of the common liquid chamber 13 of the second liquid flow path 16. In the case of the conventional liquid flow passage structure having no movable member 31, amounts of the liquid flowing from the ejection outlet side and from the common liquid chamber into the bubble collapsing position depend upon magnitudes of flow resistances in the portions closer to the ejection outlet and to the common liquid chamber than the bubble generation region (which are based on resistances of flow paths and inertia of the liquid).

If the flow resistance is smaller on the side near the ejection outlet, the liquid flows more into the bubble collapsing position from the ejection outlet side so as to increase an amount of retraction of meniscus. Particularly, as the flow resistance near the ejection outlet is decreased so as to raise the ejection efficiency, the retraction of meniscus M becomes greater upon collapse of bubble and the period of refilling time becomes longer, thus becoming a hindrance against high-speed printing.

In contrast with it, because this structure includes the movable member 31, the retraction of meniscus stops when the movable member returns to the initial position upon collapse of bubble and thereafter the supply of the liquid for the remaining volume of W2 mainly relies on the liquid supply from the flow $V_{D2}$ through the second flow path 16, where the volume W of the bubble is split into the upper volume W1 beyond the first position of the movable member and the lower volume W2 on the side of the bubble generation region 11. The retraction of meniscus appeared in the volume equivalent to approximately a half of the volume W of bubble in the conventional structure, whereas the above structure enabled to reduce the retraction of meniscus to a smaller volume, specifically, to approximately a half of W1.

Additionally, the liquid supply for the volume W2 can be forced, using the pressure upon collapse of bubble, along the surface of the movable member 31 on the heat generating element side and mainly from the upstream side ($V_{D2}$) of the second liquid flow path, thus realizing faster refilling.

A characteristic point here is as follows: if refilling is carried out using the pressure upon collapse of bubble in the conventional head, vibration of meniscus is so great as to result in deteriorating the quality of image; whereas, refilling in this structure can decrease the vibration of meniscus to an extremely low level because the movable member restricts flow of the liquid in the region of the first liquid flow path 14 on the ejection outlet side and in the region on the ejection outlet side of the bubble generation region 11.

The above-mentioned structure applicable to the present invention achieves forced refilling of the liquid into the bubble generation region through the liquid supply passage 12 of the second flow path 16 and suppression of the retraction and vibration of meniscus as discussed above, so as to perform high-speed refilling, whereby it can realize stable ejection and it can also realize an improvement in quality of image and high-speed recording when employed in applications of high-speed and repeated ejections or in the field of recording.

The above structure applicable to the present invention is also provided with a further effective function as follows. It is to suppress propagation of the pressure raised by generation of bubble to the upstream side (the back wave). The most of the pressure of the bubble on the side of the common liquid chamber 13 (or on the upstream side) among the bubble generated above the heat generating element 2 was conventionally the force to push the liquid back to the upstream side (which is the back wave). This back wave raised the upstream pressure and a liquid movement amount and caused inertial force due to movement of the liquid, which degraded the refilling of the liquid into the liquid flow path and also hindered high-speed driving. This structure further improved refilling performance also by suppressing these actions to the upstream side by the movable member 31.

Next explained are further characteristic structures and effects.

The second liquid flow path 16 has the liquid supply passage 12 having an internal wall, which is substantially flatly continuous from the heat generating element 2 (which means that the surface of the heat generating element is not stepped down too much), on the upstream side of the heat generating element 2. In this case, the liquid is supplied to the bubble generation region 11 and the surface of the heat generating element 2 along the surface of the movable member 31 nearer to the bubble generation region 11, as indicated by $VD_2$. This stops stagnation of the liquid above the surface of the heat generating element 2 and easily removes the so-called residual bubbles which are separated out from the gas dissolved in the liquid or which remain without being collapsed. Further, the heat is prevented from accumulating in the liquid. Accordingly, stabler generation of bubble can be repeated at high speed. Although this structure was explained with the liquid supply passage 12 having the substantially flat internal wall, without having to be limited to this, the liquid supply passage may be any having a gentle internal wall smoothly connected to the surface of the heat generating element as long as it is shaped so as not to cause stagnation of the liquid above the heat generating element or great turbulent flow in the supply of liquid.

There occurs some supply of the liquid into the bubble generating region from $V_{D1}$ through the side of the movable member (through the slit 35). In order to guide the pressure upon generation of bubble more effectively to the ejection outlet, such a movable member as to cover the whole of the bubble generation region (as to cover the surface of the heat generating element), as shown in FIGS. 2A to 2D, may be employed. When the movable member 31 returns to the first position in that case, the flow resistance of the liquid is so great in the bubble generation region 11 and in the region near the ejection outlet of the first liquid flow path 14. In such cases, the liquid is restricted from flowing from $V_{D1}$ as described above toward the bubble generation region 11. Since the head structure in this structure has the flow $VD_2$ for supplying the liquid to the bubble generation region, it has very high supply performance of the liquid. Thus, the supply performance of the liquid can be maintained even in the structure with improved ejection efficiency in which the movable member 31 covers the bubble generation region 11.

Figure 6:
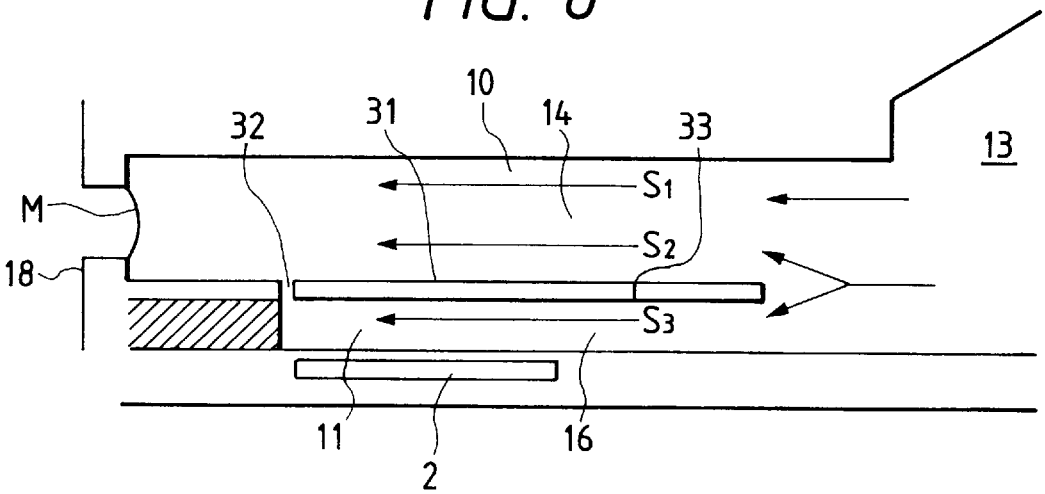
FIG. 6 is a schematic view of a liquid flow in the ejection principle applied to the present invention.

Incidentally, the positional relation between the free end 32 and the fulcrum of the movable member 31 is defined in such a manner that the free end is located downstream relative to the fulcrum, for example as shown in FIG. 6. This structure can efficiently realize the function and effect to guide the pressure propagation direction and the growing direction of bubble to the ejection outlet upon generation of bubble, as discussed previously. Further, this positional relation achieves not only the function and effect for ejection, but also the effect of high-speed refilling as decreasing the flow resistance against the liquid flowing in the liquid flow path 10 upon supply of liquid. This is because, as shown in FIG. 6, the free end 32 and fulcrum 33 are positioned so as not to resist the flows S1, S2, S3 flowing in the liquid flow path 10 (including the first liquid flow path 14 and the second liquid flow path 16) when the meniscus M at a retracted position after ejection returns to the ejection outlet 18 because of the capillary force or when the liquid is supplied to compensate for the collapse of bubble.

Explaining in further detail, in this structure (FIGS. 2A to 2D) the movable member 31 extends relative to the heat generating element 2 so that the free end 32 thereof is opposed thereto at a downstream position with respect to the area center 3 (the line passing through the center of the area of the heat generating element (through the central portion) and being perpendicular to the lengthwise direction of the liquid flow path), separating the heat generating element 2 into the upstream region and the downstream region, as described previously. This arrangement causes the movable member 31 to receive the pressure or the bubble occurring downstream of the area center position 3 of the heat generating element and greatly contributing to the ejection of liquid and to guide the pressure and bubble toward the ejection outlet, thus fundamentally improving the ejection efficiency and the ejection force.

Further, many effects are attained as also utilizing the upstream portion of the bubble in addition. It is presumed that effective contribution to the ejection of liquid also results from instantaneous mechanical displacement of the free end of the movable member 31 in this structure.

(Embodiment 1)

The embodiments of the present invention will be explained with reference to the accompanying drawings.

The present embodiment also employs the same main principle of ejection of liquid as described above. Each embodiment to follow will be explained using a head in which the first liquid flow path 14 and the second liquid flow path 16 are separated by the partition wall 30 as in the following description, but it is noted that, without having to be limited to this, the present invention can be similarly applied to the heads including that in the above description of the principle.

Figure 7:
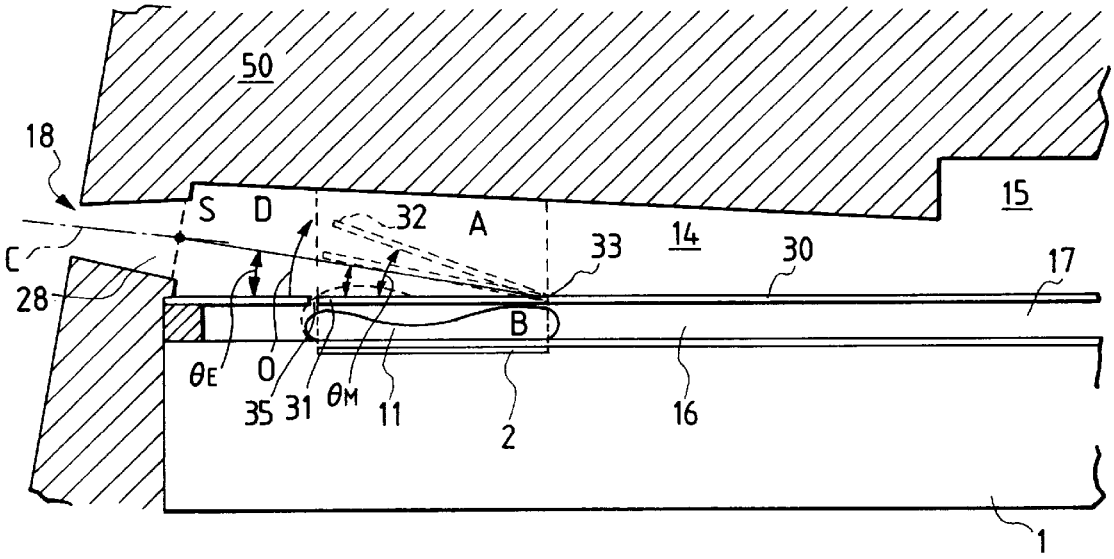
FIG. 7 is a partly broken sectional view of a liquid ejecting head according to an embodiment of the present invention.

FIG. 7 is a schematic sectional view, taken along the direction of flow path, of the liquid ejecting head in the present embodiment.

The liquid ejecting head of the present invention has an element substrate 1 and a heat generating element 2, mounted thereon, for supplying the thermal energy for generating a bubble in the liquid, and above the element substrate 1 there are provided a second liquid flow path 16 for bubble generation liquid and a first liquid flow path 14 for ejection liquid in direct communication with an ejection outlet portion 28 having an ejection outlet, disposed above the second liquid flow path. A partition wall 30, made of a material having elasticity, such as a metal, is disposed between the first liquid flow path 14 and the second liquid flow path 16 and separates the ejection liquid inside the first liquid flow path 14 from the bubble generation liquid in the second liquid flow path 16. Here, a same liquid may be used as the ejection liquid and as the bubble generation liquid, similarly as in the description of principle stated previously. In that case, a communication portion (not shown) may be formed in at least a part of the partition wall 30 so that the liquid may flow between a first common liquid chamber 15 communicating with the first flow path and a second common liquid chamber 17 communicating with the second flow path 16.

The ejection outlet portion 28 has an opening portion of a small diameter (ejection outlet 18) through which a liquid droplet is ejected from the head and an aperture portion of a large diameter as a connecting portion with the first liquid flow path 14. The center axis and an extension thereof perpendicular to the ejection outlet 18 are nearly aligned with the center axis C along a direction in which the liquid droplet flies after ejected. Further, S represents an intersecting point between the above center axis C and a surface corresponding to the connecting portion between the ejection outlet portion 28 and the first liquid flow path 14.

Similarly as in the above-description of principle, a slit aperture portion (a slit, see FIG. 9A) 35 is formed in the partition wall 30 at a portion located in a projection space above the surface of heat generating element (which will be referred to as an ejection force generating region, including the region of A and the bubble generation region of B in FIG. 7). The movable member 31 is provided as being capable of substantially sealing this slit 35. Specifically, the movable member 31 is a member shaped in a cantilever form having a free end on the ejection outlet 18 side (or on the downstream side of the flow of liquid) and a fixed end on the first/second common liquid chamber (15, 17) side and being rotatable about a fulcrum portion 33 of the fixed end. As shown in the drawing, the movable member 31 faces the bubble generation region B, and rotates in the direction of arrow 0 about the fulcrum portion of the movable member as being pushed up toward the first liquid flow path side with generation of bubble in the bubble generation liquid, as described hereinafter. This rotation displaces the movable member 31 to the first flow path side.

Figure 8:
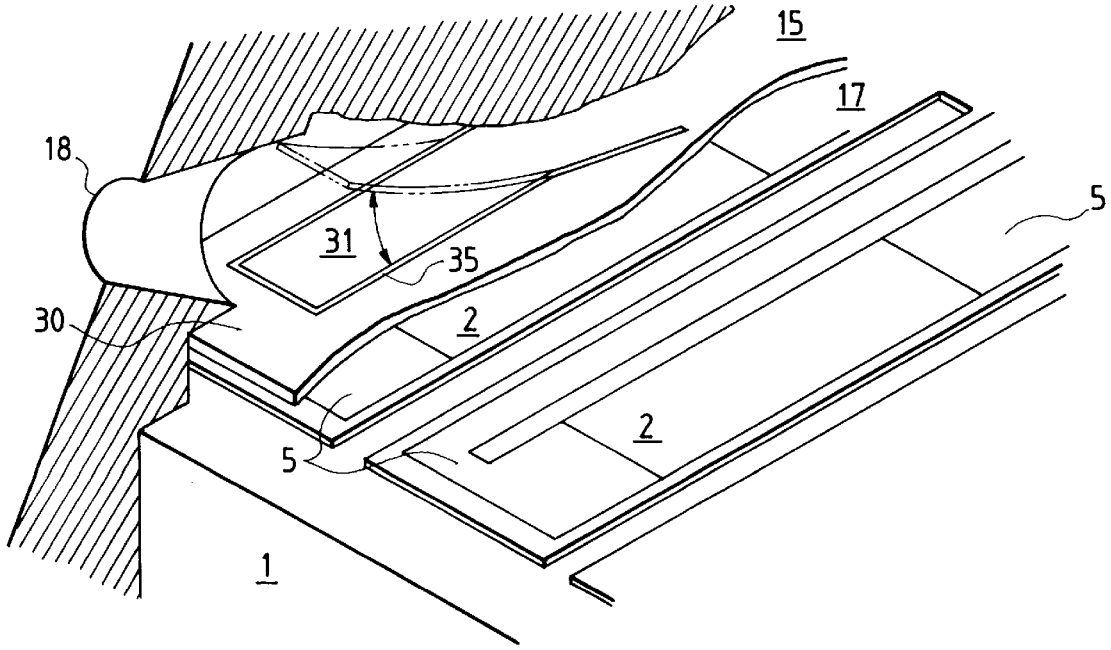
FIG. 8 is a partly broken perspective view of a liquid ejecting head applied to the present invention.

FIG. 8 is a perspective view to show the schematic structure of the liquid ejecting head according to the present invention. From this figure it is also understood that the partition wall 30 is located through the space constituting the second liquid flow path 16 above the substrate 1 provided with the electrothermal transducer (electrothermal transducing element) as a heat generating element 2 and wiring electrode 5 for applying an electric signal to the electrothermal transducer.

Figure 9A:
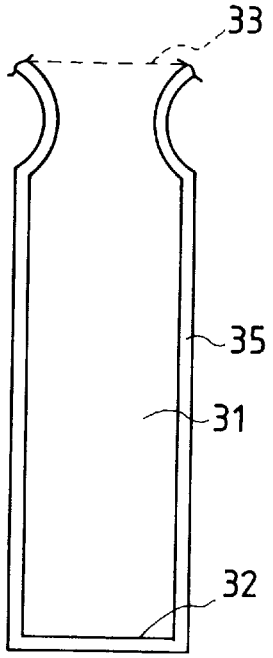
FIGS. 9A, 9B, and 9C show a positional relation between the heat generating element and the movable member.
Figure 9B:
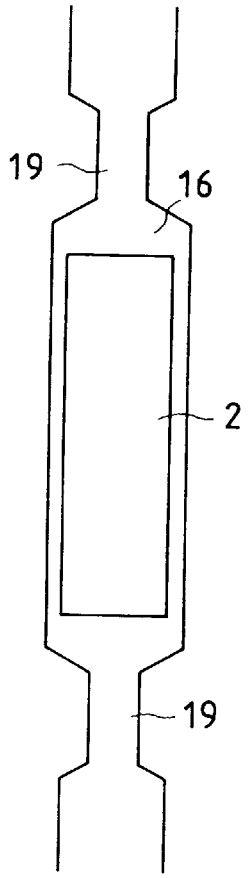
Figure 9C:
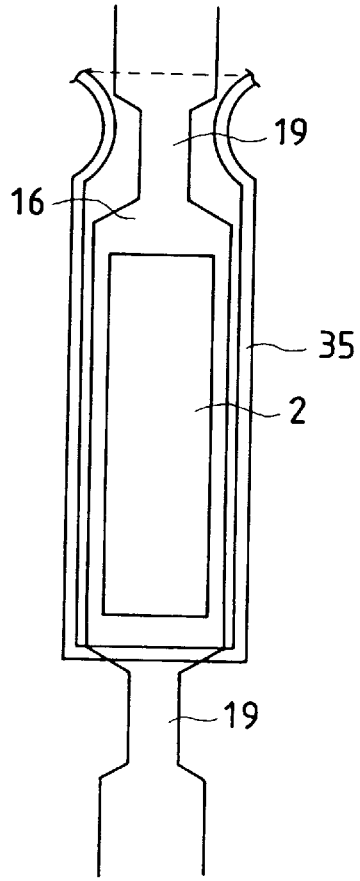

FIGS. 9A to 9C are drawings for explaining the positional relation between the movable member 31 and the second liquid flow path 16 as described above, wherein FIG. 9A is a view of the movable member 31, observed from the side of the first flow path 14, and FIG. 9B a view of the second liquid flow path 16, observed from the side of the first flow path 14 as taking the partition wall 30 away. Further, FIG. 9C is a perspective view to schematically show the positional relation between the movable member 31 and the second liquid flow path 16 in an overlaying state. In either drawing the direction toward the free end 32 of the movable member 31 corresponds to the direction to the location of the ejection outlet 18. The fulcrum portion stated above is the end of the slit 35 for forming the movable member (or the root of the movable member).

The second liquid flow path 16 is formed in such a chamber (bubble generation chamber) structure as to have throat portions 19 before and after the heat generating element 2 and thereby to restrict the pressure upon generation of bubble from escaping through the second liquid flow path 16. In the case of the conventional head using a common flow path serving as a flow path for generation of bubble and also as a flow path for ejection of liquid and in order to provide the head with such a throat portion as to prevent the propagation direction of the pressure generated on the liquid chamber side of the heat generating element from being directed toward the common liquid chamber side, it was necessary to employ a structure not to narrow the cross-sectional area of flow path too much in the throat portion, taking refilling of the liquid ejected into full consideration.

In contrast, the present embodiment is arranged in such a structure that the most liquid ejected is the ejection liquid in the first liquid flow path 14 and little bubble generation liquid is consumed in the second liquid flow path 16 in which the heat generating element 2 is provided. Therefore, only a small filling amount is necessary for supplying the bubble generation liquid into the ejection pressure generating portion of the second liquid flow path 16. In the cases using the structure of less consumption of the bubble generation liquid, the clearance in the throat portions 19 can be set to be very narrow, for example several $\mu$m to ten and several $\mu$m, so that the propagation direction of the pressure upon generation of bubble in the second liquid flow path 16 can be concentrated toward the movable member 31. As a result, the propagation direction of the pressure can be guided to the ejection outlet by the movable member 31, thereby achieving higher ejection efficiency and higher ejection pressure.

It is noted here that the configuration of the second liquid flow path 16 is not limited to the above structure, but may be any configuration as long as it can effectively transmit the pressure upon generation of bubble to the movable member.

The displacement angle of the movable member stated below indicates a displacement of the movable member 31 with respect to the reference at the reference surface stated previously. Let us define $\theta_M$ as a maximum value of the displacement angle of the movable member and $\theta_E$ as an angle of displacement of a straight line (axis) D connecting the above intersecting point S with the fulcrum portion 33 of the movable member with respect to the reference surface of the movable member (see FIG. 7).

A specific example of a method for specifying the displacement angle of the movable member is a method for forming the ceiling of the first liquid flow path of a transparent material or replacing it with a transparent member, optically measuring a height of the free end portion when the movable member is displaced (a height from a non-displaced position), and calculating the displacement angle from the position of the free end portion and the position of the fulcrum to specify it.

Figure 10:
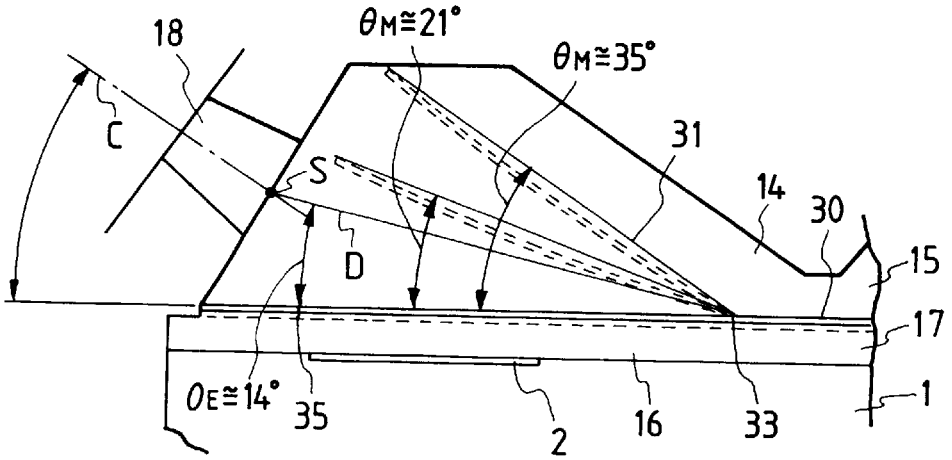
FIG. 10 is a schematic drawing to show a first example of the relation between $\theta_M$ and $\theta_E$.

FIG. 10 shows a schematic cross section, taken along the direction of flow path, of the liquid ejecting head of the present embodiment, and is a drawing to show a relation among the maximum value $\theta_M$ of the displacement angle of the movable member, the displacement angle $\theta_E$ of the straight line D connecting the intersecting point S with the fulcrum of the movable member with respect to the reference surface of the movable member, and an angle $\theta_c$ of the center axis C in the direction of the droplet flying upon ejection of droplet with respect to the reference surface of the movable member. The liquid ejecting head of this embodiment is so arranged that the maximum displacement angle $\theta_M$ of the movable member is determined in the range of $2\theta_E-7° \leqq \theta_M \leqq 2\theta_E+7°$ with respect to the angle $\theta_E$ of the straight line D connecting the intersecting point S with the fulcrum portion of the movable member from the reference surface of the movable member by adjusting the thickness of the movable member or adjusting the height of the ceiling of the first liquid flow path. The present embodiment shows an example in which $\theta_E=14°$ and $\theta_M$ is thus between 35° and 21°.

In the arrangement shown herein where the movable member is displaced by the pressure based on the bubble generated in the bubble generation region 11 by the heat generating element 2 and the movable member 31 guides the pressure toward the ejection outlet, it is very important in respect of the liquid ejection characteristics to efficiently direct the pressure based on the bubble from the portion of the free end 32 displaced, of the movable member 31 toward the aperture portion of the ejection outlet 18 on the side of the first liquid flow path 14, as shown by V1–V4 in FIG. 5, by taking account of the relation between the displacement angle of the movable member 31 and the aperture portion on the side connected to the first liquid flow path 14.

Namely, if the relation near $\theta_M=2\,\theta_E$ is satisfied, the flow path configuration of the portion between the movable member in the maximum displacement state and the reference surface becomes of line symmetry with respect to a symmetry axis of the straight line D, so that the central portion of propagation of the pressure by the bubble is directed straight to the center S of the aperture portion of the ejection outlet 18 on the flow path side. This establishes propagation of the pressure and liquid flow caused thereby without turbulence along the center axis C of the ejection outlet portion, whereby the direction of the liquid ejected through the ejection outlet 18 is maintained in the very stable direction along the direction of the center axis C. The stability of the ejection direction is thus remarkably improved by satisfying the relation near $\theta_M=2\theta_E$, whereby the shot accuracy is enhanced on a printing sheet and disturbance of quality of image is greatly reduced.

Here, the connecting portion between the ejection outlet portion and the liquid flow path means a portion of a tubular portion (in the configuration of a cylindrical straight tube, a tapered tube, or a curved tapered tube, which will be referred to as an ejection outlet portion) forming the ejection outlet portion closest to the liquid flow path out of the tubular portion forming the ejection outlet, or a portion near it.

Taking account of the variations or the like of the configuration of the ejection outlet when formed by irradiation or the like with laser, the condition near $\theta_M=2\theta_E$ is determined to include the range of $2\theta_E-7° \leqq \theta_M \leqq 2\theta_E+7°$. A more preferable condition to enhance the effect of the stability of the ejection direction discussed above is $2\theta_E-5° \leqq \theta_M \leqq 2\theta_E+5°$.

In addition to the above condition, the maximum displacement angle $\theta_M$ of the movable member is equal to or more than the angle of the straight line connecting the fulcrum portion with the uppermost end of the aperture of the ejection outlet portion connected to the liquid flow path 14, which is a preferable condition for smooth propagation of pressure of the bubble 40 and smooth flow of the liquid caused thereby.

Further, $\theta_M$ is preferably determined within the range of acute angles, considering distortion or the like of the fulcrum portion 33 of the movable member 31, and more preferably, is not more than 35°. These stipulations of the upper limit and the lower limit of $\theta_M$ are also applied to the other embodiments from the same reasons.

(Embodiment 2)

Figure 11:
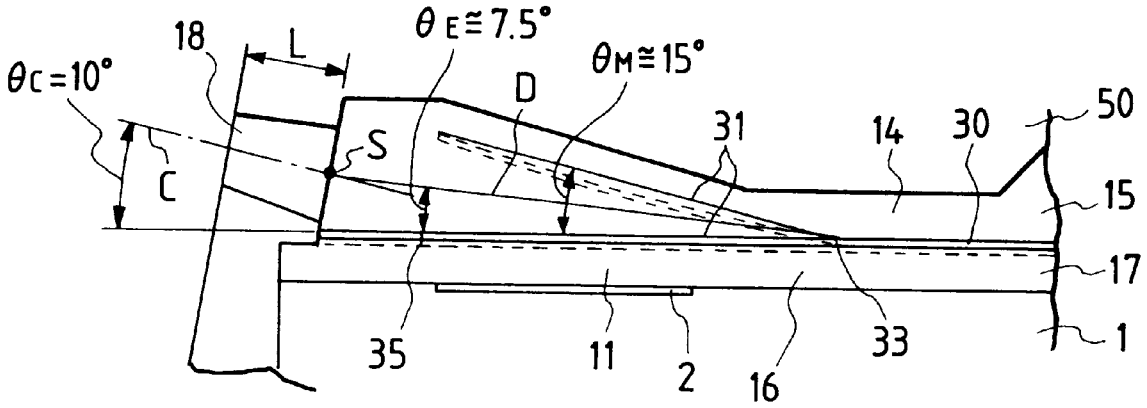
FIG. 11 is a schematic drawing to show a second example of the relation between $\theta_M$ and $\theta_E$.

Next, FIG. 11 shows a schematic cross section, taken along the direction of flow path, of the liquid ejecting head of the present embodiment and is a drawing to show a relation among the maximum value $\theta_M$ of the displacement angle of the movable member, the displacement angle $\theta_E$ of the straight line D connecting the fulcrum portion 33 of the movable member with the intersecting point S with respect to the reference surface of the movable member, and the angle $\theta_c$ of the center axis C in the direction of the liquid droplet flying upon ejection of liquid droplet with respect to the position of the reference surface of the movable member. Here, the position of the fulcrum portion 33 is located near the cut end of the slit 35 in FIGS. 9A–9C, similarly as defined hereinbefore.

Figure 15A:
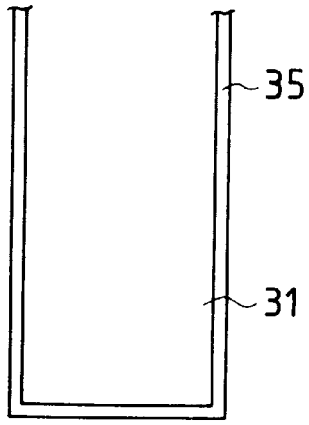
FIGS. 15A, 15B, and 15C are illustrations of other configurations of the movable member.
Figure 15B:
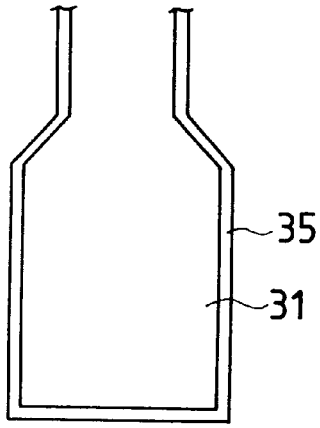
Figure 15C:
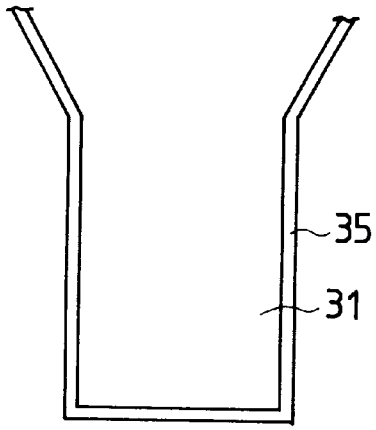

In this embodiment, the maximum displacement angle $\theta_M$ of the movable member was determined to be 15° by forming the movable member in the configuration widened to the end in the fulcrum portion, as shown in FIG. 15C, 250 μm (±5 μm) long, 36 μm wide, and 5 μm thick and made of Ni. Further, the height of the first liquid flow path 14 was in the range of 40 μm to 60 μm and the height of the second liquid flow path 16 was 15 μm in the present embodiment. However, FIG. 11 shows an example in which the height of the first flow path is 40 μm. When the ejection outlet is formed by irradiation with laser, the displacement angle $\theta_E$ of the straight line D connecting the fulcrum of the movable member with the intersecting point S with respect to the reference surface of the movable member 31 is defined within the range of 5° to 7.5° (preferably $6° \leqq \theta_E \leqq 6.5°$) and it is formed to satisfy the relations of $\theta_E=2\theta_E$ and $2\theta_E \leqq \theta_M \leqq 2\theta_E+5$. In this embodiment the angle $\theta_c$ of the center axis C in the direction of the liquid droplet flying upon ejection of droplet with respect to the non-displaced position of the movable member 31 was determined to be 10°. The driving conditions of the head were the voltage of several V to several ten V, the electric current of approximately 0.1 to 0.2 A, and the pulse width of 1.5 to 10 μsec, and the length L of the ejection outlet portion was determined between 30 and 50 μm.

To satisfy the condition near $\theta_M=2\theta_E$ is also a very important factor for stabilization of ejection direction in the present embodiment, similarly as in the previous embodiment.

As a further method for maintaining this state in the ejection operation period for a longer time, the movable member 31 may be operated so as to exceed $\theta_M$ satisfying $\theta_M=2\theta_E$. Arranging to satisfy the relation of $2\theta_E \leqq \theta_M \leqq 2_E+5°$, this arrangement attained stabilization of ejection direction and stabler ejection efficiency. Further, this also improved stabilization of ejection state against variations of the configuration of ejection outlet as discussed previously.

Figure 16:
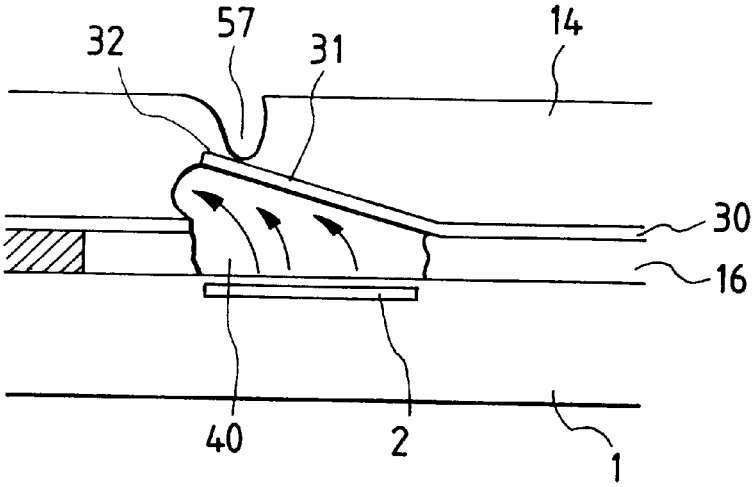
FIG. 16 is a schematic drawing to show an example of a ceiling stopper for satisfying the condition of the angle in the present invention.

A further preferable condition is to satisfy the condition near the center of the relation of $2\theta_E<\theta_M \leqq 2\theta_E+5$ ($6° \leqq \theta_E \leqq 6.50$ in the present embodiment). Another means for satisfying this relation of $2\theta_E=\theta_M$ is to provide a part of the wall of the first flow path 14 with a control portion 57 of the maximum displacement angle $\theta_M$ as shown in FIG. 16.

(Embodiment 3)

Figure 12:
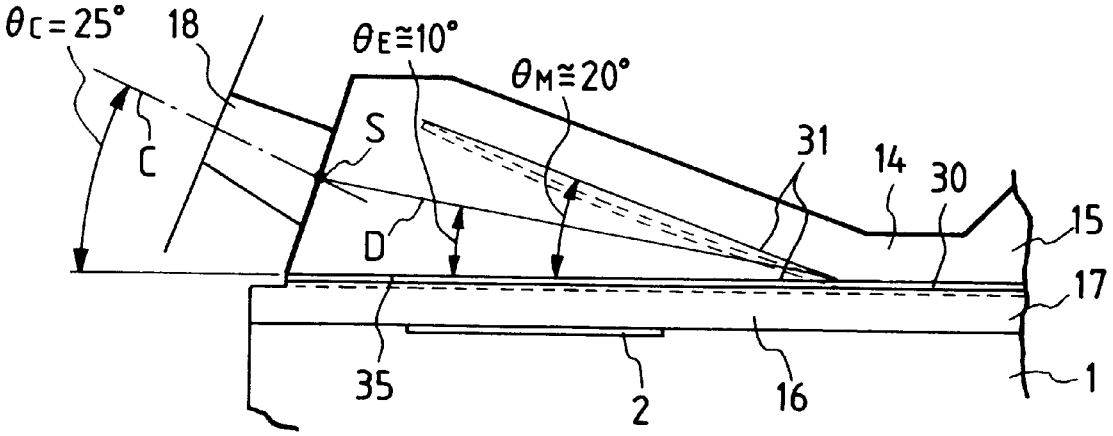
FIG. 12 is a schematic drawing to show a third example of the relation between $\theta_M$ and $\theta_E$.

FIG. 12 shows a schematic cross section, taken along the direction of flow path, of the liquid ejecting head of the present embodiment, similar to those of Embodiments 1 and 2, and is a drawing to show a relation among the maximum value $\theta_M$ of the displacement angle of the movable member, the displacement angle $\theta_E$ of the straight line D connecting the fulcrum of the movable member with the intersecting point S with respect to the natural position of the movable member, and the angle $\theta_c$ of the center axis C in the direction of the liquid droplet flying upon ejection of droplet with respect to the natural position of the movable member. The liquid ejecting head of this embodiment has the structure similar to that of Embodiment 1, but the maximum displacement angle $\theta_M$ of the movable member is determined to be approximately 20° by decreasing only the thickness of the movable member in the previous embodiment to 3.5 μm. The displacement angle $\theta_E$ of the straight line D connecting the fulcrum of the movable member with the intersecting point S with respect to the natural position of the movable member is determined within the range of 10° to 12.50 (preferably $11° \leqq \theta_E \leqq 12°$) upon formation of ejection outlet by the aforementioned method, and it is arranged to satisfy the relation of $\theta_M=2\theta_E$ or $2\theta_E>\theta_M \leqq 2\theta_E-5$. In this embodiment the angle $\theta_c$ of the center axis C in the direction of the droplet flying upon ejection of droplet with respect to the natural position of the movable member was determined to be 25° (the value of L is the same as in Embodiment 1). Further, the height of the second liquid flow path 16 was the same as in previous Embodiment 1 and the height of the first flow path was between 40 μm and 80 μm in the present embodiment. However, FIG. 12 shows an example in which the height of the first liquid flow path 14 is 60 μm. The driving conditions are also the same as those in the previous embodiments.

When the relation of $\theta_M=2\theta_E$ is satisfied in the present embodiment, the stability of ejection direction is also improved similarly as in Embodiments 1, 2 stated above.

Also in the case of the relation of $2\theta_E>\theta_M \leqq 2\theta_E-5$ being satisfied, the effect is attained to stabilize the ejection state caused by variations or the like of the configuration of ejection outlet as described previously.

A preferable condition to further improve such an effect is to satisfy the condition near the center of $2\theta_E>\theta_M \leqq 2\theta_E-5°$ ($11° \leqq \theta_E \leqq 12°$ in the present embodiment). Also in the case of the present embodiment another means for satisfying the relation of $\theta_E$ and $\theta_M$ is to provide a part of the wall of the first flow path 14 with a control portion 57 of maximum displacement angle $\theta_M$ as shown in FIG. 16.

Figure 13:
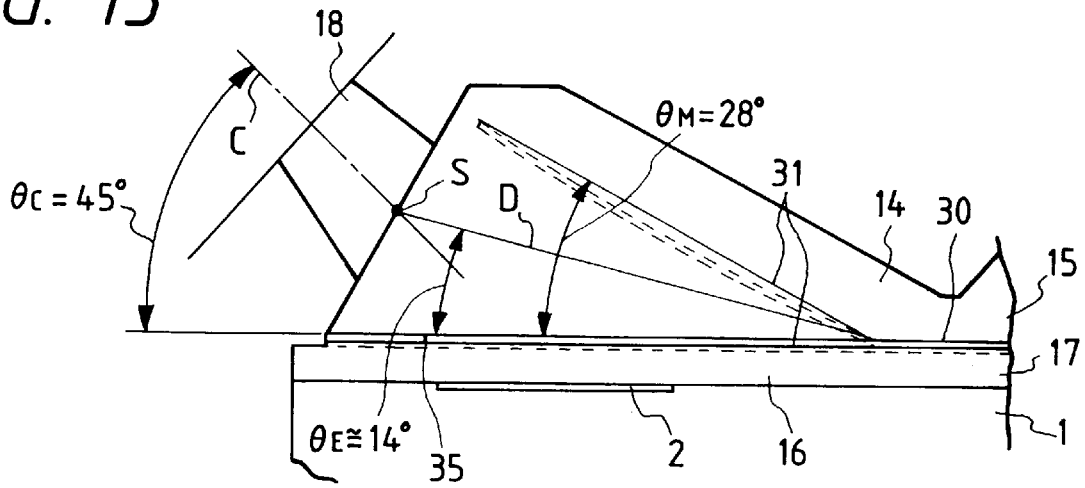
FIG. 13 is a schematic drawing to show a fourth example of the relation between $\theta_M$ and $\theta_E$.
Figure 14A:
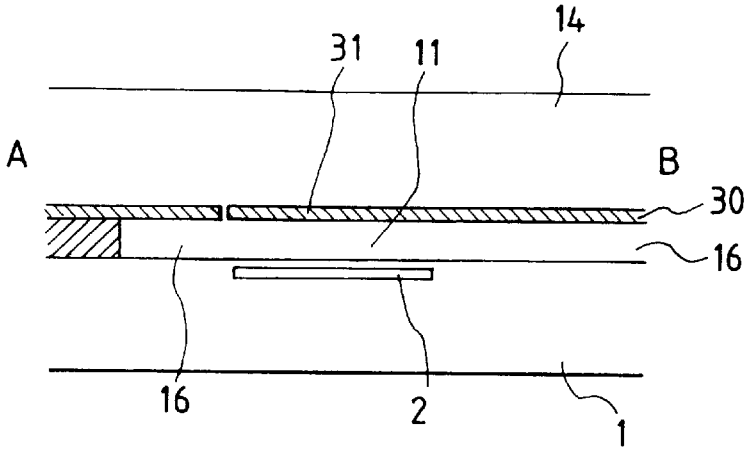
FIGS. 14A and 14B are illustrations of an operation of a movable member.
Figure 14B:
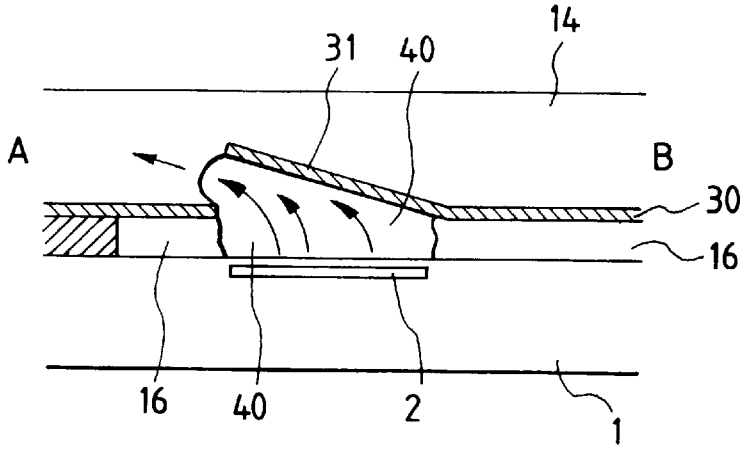

Further, $\theta_M$ is determined in the range of acute angles, considering the fulcrum portion 33 of the movable member 31. FIG. 13 shows an example in which $\theta_M$ is 28° and $\theta_E$ is 14°, which achieved the same effects as described above.

As shown in each embodiment described above, the free end can be smoothly displaced by setting the height of the ceiling of the flow path communicating with the ejection outlet higher on the free end side of the movable member than on the fulcrum side.

Each of Embodiments 1 to 3 described above has the configuration of the bubble generation flow path shown in FIGS. 9A to 9C where the throat portions 19 narrowed in the direction of arrangement of a plurality of bubble generation flow paths arranged in parallel are positioned near the upstream end and the downstream end of the second liquid flow path, but they may be located near the upstream end and the downstream end of the vicinity of the heat generating element 2.

The heat generating element 2 is an electrothermal transducer in the configuration of 40×105 μm and the movable member 31 is positioned so as to cover the aforementioned chamber in which the heat generating element 2 is disposed. The size, configuration, and location of the heat generating element 2 or the movable member 31 are not limited to these, but the configuration and location may be determined within the range where the pressure upon generation of bubble can be effectively utilized as an ejection pressure. The heat generating element may be an element for generating heat when irradiated with laser light, as well as the electrothermal transducer.

(Other embodiments)

In the foregoing, the description has been made as to the embodiments of the major parts of the liquid ejecting head and the liquid ejecting method according to the present invention. Further specific examples preferably applicable to these embodiments will be explained with reference to the drawings. Although the following examples will be explained with either an embodiment of the single-flow-path type or an embodiment of the two-flow-path type described previously, it should be noted that they can be applied to the both embodiments unless otherwise stated. (Movable member and partition wall)

FIGS. 15A, 15B, and 15C are plan views to show other configurations of the movable member 31, wherein reference numeral 35 designates the slit formed in the partition wall and this slit forms the movable member 31. FIG. 15A illustrates a rectangular configuration, FIG. 15B a configuration narrowed on the fulcrum side to facilitate the operation of the movable member, and FIG. 15C a configuration widened on the fulcrum side to enhance the durability of the movable member. The configuration of the movable member may be any configuration readily operable and excellent in the durability.

In the foregoing embodiments, the plate movable member 31 and the partition wall 30 having this movable member were made of nickel in the thickness of 5 μm, but, without having to be limited to this, the materials for the movable member and the partition wall may be selected from those having anti-solvent property against the bubble generation liquid and the ejection liquid, having elasticity for assuring the satisfactory operation of the movable member, and permitting formation of fine slit.

Preferable examples of the material for the movable member include durable materials, for example, metals such as silver, nickel, gold, iron, titanium, aluminum, platinum, tantalum, stainless steel, or phosphor bronze, alloys thereof, resin materials, for example, those having the nitryl group such as acrylonitrile, butadiene, or styrene, those having the amide group such as polyamide, those having the carboxyl group such as polycarbonate, those having the aldehyde group such as polyacetal, those having the sulfone group such as polysulfone, those such as liquid crystal polymers, and chemical compounds thereof; and materials having durability against the ink, for example, metals such as gold, tungsten, tantalum, nickel, stainless steel, titanium, alloys thereof, materials coated with such a metal, resin materials having the amide group such as polyamide, resin materials having the aldehyde group such as polyacetal, resin materials having the ketone group such as polyetheretherketone, resin materials having the imide group such as polyimide, resin materials having the hydroxyl group such as phenolic resins, resin materials having the ethyl group such as polyethylene, resin materials having the alkyl group such as polypropylene, resin materials having the epoxy group such as epoxy resins, resin materials having the amide group such as melamine resins, resin materials having the methylol group such as xylene resins, chemical compounds thereof, ceramic materials such as silicon dioxide, and chemical compounds thereof.

Preferable examples of the material for the partition wall include resin materials having high heat-resistance, high anti-solvent property, and good moldability, typified by recent engineering plastics, such as polyethylene, polypropylene, polyamide, polyethylene terephthalate, melamine resins, phenolic resins, epoxy resins, polybutadiene, polyetheretherketone, polyether sulfone, polyallylate, polyimide, polysulfone, liquid crystal polymers (LCPs), chemical compounds thereof, silicon dioxide, silicon nitride, metals such as nickel, gold, or stainless steel, alloys thereof, chemical compounds thereof, or materials coated with titanium or gold.

The thickness of the partition wall may be determined depending upon the material and configuration from such standpoints as to achieve the strength as a partition wall and to well operate as a movable member, and a desirable range thereof is approximately between 0.5 $\mu$m and 10 $\mu$m.

The width of the slit 35 for forming the movable member 31 is determined to be 2 $\mu$m in the present embodiment. In the cases where the bubble generation liquid and the ejection liquid are mutually different liquids and mixture is prevented between the two liquids, the slit width may be determined to be a clearance to form a meniscus between the two liquids so as to avoid communication between the two liquids. For example, when the bubble generation liquid is a liquid having the viscosity of about 2 cP (centipoises) and the ejection liquid is a liquid having the viscosity of 100 or more cP, a slit of approximately 5 $\mu$m is enough to prevent the mixture of the liquids, but a desirable slit is 3 or less $\mu$m.

In the present invention the movable member is intended to have a thickness of the $\mu$m order (t $\mu$m), but is not intended to have a thickness of the cm order. For the movable member in the thickness of the pm order, it is desirable to take account of the variations in fabrication to some extent when the slit width of the $\mu$m order (W $\mu$m) is targeted.

The slit of such several $\mu$m order is surer to accomplish the "substantially sealed state" in the present invention.

In the case of the functional separation into the bubble generation liquid and the ejection liquid as described above, the movable member is a substantially separating member for separating them. When this movable member moves with generation of bubble, a small amount of the bubble generation liquid appears mixing into the ejection liquid. Considering that the ejection liquid for forming an image is usually one having the concentration of coloring material ranging approximately 3% to 5% in the case of the ink jet recording, a great change in the concentration will not be resulted even if the bubble generation liquid is contained in the range of 20 or less % in a droplet of the ejection liquid. Therefore, the present invention is intended to involve mixture of the liquids between the bubble generation liquid and the ejection liquid as long as the mixture is limited within 20% of the bubble generation liquid in the droplet of the ejection liquid.

In carrying out the above structural examples, the mixture was at most 15% of the bubble generation liquid even with changes of the viscosity, and with the bubble generation liquid of 5 or less cP the mixture rate was at most approximately 10%, though depending upon the driving frequency.

Particularly, as the viscosity of the ejection liquid is decreased below 20 cP, the mixture of the liquids can be decreased more (for example, down to 5 or less %).

(Element substrate)

Next explained is the configuration of the element substrate in which the heat generating element for supplying heat to the liquid is mounted.

Figure 17A:
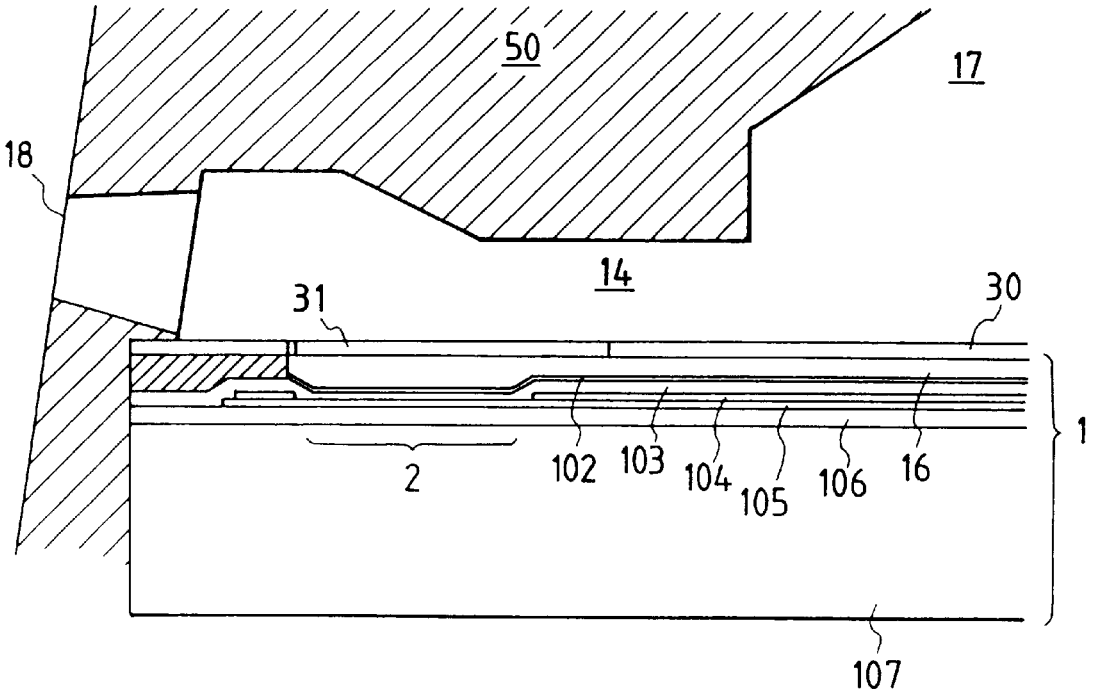
FIGS. 17A and 17B are longitudinal cross sections of a liquid ejecting head according to an embodiment of the present invention.
Figure 17B:
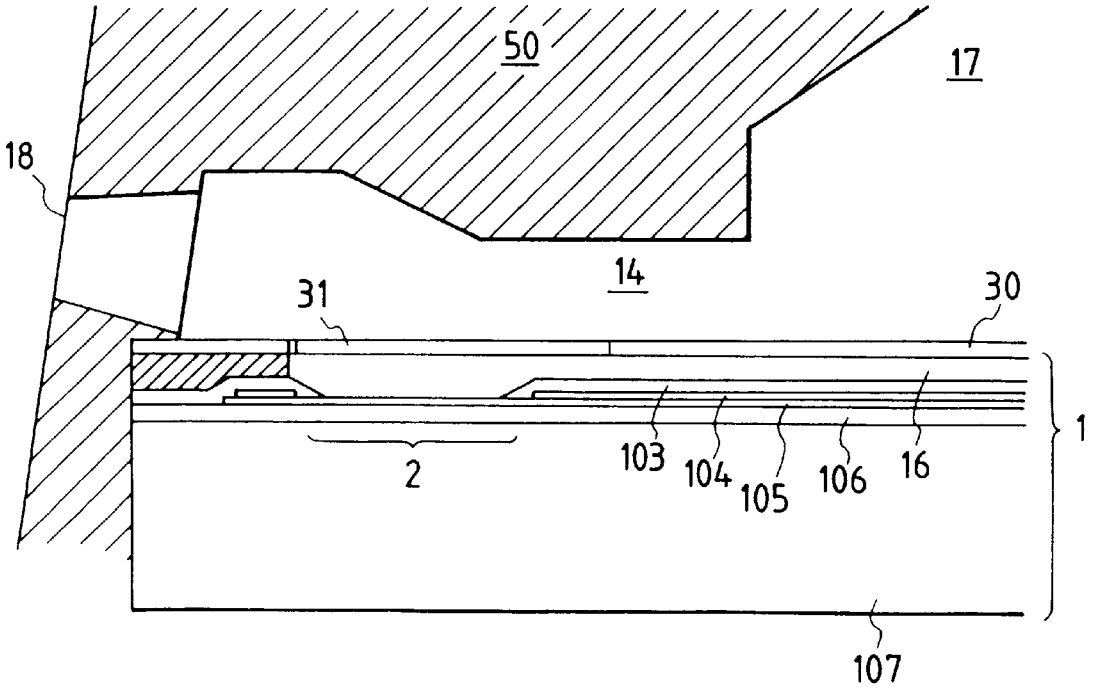

FIGS. 17A and 17B show longitudinal sectional views of the liquid ejecting heads according to the present invention, wherein FIG. 17A shows the head with a protection film as detailed hereinafter and FIG. 17B the head without a protection film.

Above the element substrate 1 there are provided the second liquid flow path 16, the partition wall 30, the first liquid flow path 14, and a grooved member 50 having a groove for forming the first liquid flow path.

The element substrate 1 has patterned wiring electrodes (0.2–1.0 $\mu$m thick) of aluminum (Al) and patterned electric resistance layer 105 (0.01–0.2 $\mu$m thick) of hafnium boride ($HfB_2$), tantalum nitride (TaN), tantalum aluminum (TaAl) or the like constituting the heat generating elements on a silicon oxide film or silicon nitride film 106 for electric insulation and thermal accumulation formed on the substrate 107 of silicon or the like, as shown in FIG. 8. The resistance layer generates heat when a voltage is applied to the resistance layer 105 through the two wiring electrodes 104 so as to let an electric current flow in the resistance layer. A protection layer of $SiO_2$, SiN, or the like 0.1–2.0 $\mu$m thick is provided on the resistance layer between the wiring electrodes, and in addition, an anti-cavitation layer of tantalum or the like (0.1–0.6 $\mu$m thick) is formed thereon to protect the resistance layer 105 from various liquids such as ink.

Particularly, the pressure and shock wave generated upon bubble generation and collapse is so strong that the durability of the oxide film hard and relatively fragile is considerably deteriorated. Therefore, a metal material such as tantalum (Ta) or the like is used as a material for the anti-cavitation layer.

The protection layer stated above may be omitted depending upon the combination of liquid, liquid flow path structure, and resistance material, an example of which is shown in FIG. 17B. The material for the resistance layer not requiring the protection layer may be, for example, an iridium-tantalum-aluminum (Ir—Ta—Al) alloy or the like.

Thus, the structure of the heat generating element in each of the foregoing embodiments may include only the resistance layer (heat generating portion) between the electrodes as described, or may include a protection layer for protecting the resistance layer.

In this embodiment, the heat generating element has a heat generation portion having the resistance layer which generates heat in response to the electric signal. Without having to be limited to this, any means well suffices if it creates a bubble enough to eject the ejection liquid, in the bubble generation liquid. For example, the heat generation portion may be in the form of a photothermal transducer which generates heat upon receiving light such as laser, or a heat generating element having the heat generation portion which generates heat upon receiving high frequency wave.

Function elements such as a transistor, a diode, a latch, a shift register, and so on for selectively driving the electrothermal transducer may also be integrally built in the aforementioned element substrate 1 by the semiconductor fabrication process, in addition to the electrothermal transducer comprised of the resistance layer 105 constituting the heat generating element and the wiring electrodes 104 for supplying the electric signal to the resistance layer.

Figure 18:
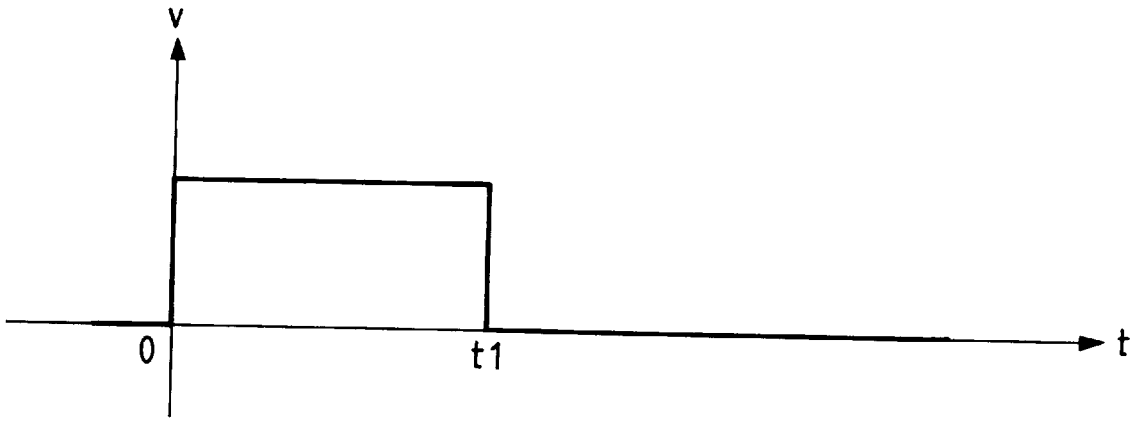
FIG. 18 is a schematic view of a configuration of a driving pulse.

In order to drive the heat generation portion of the electrothermal transducer on the above-described element substrate 1 so as to eject the liquid, a rectangular pulse as shown in FIG. 18 is applied through the wiring electrodes 104 to the aforementioned resistance layer 105 to quickly heat the resistance layer 105 between the wiring electrodes. With the heads of the foregoing embodiments, the electric signal was applied to each at the voltage 24 V, the pulse width 7 $\mu$sec, the electric current 150 mA, and the frequency 6 kHz to drive the heat generating element, whereby the ink as a liquid was ejected through the ejection outlet, based on the operation described above. However, the conditions of the driving signal are not limited to the above, but any driving signal may be used if it can properly generate a bubble in the bubble generation liquid.

(Ejection liquid and bubble generation liquid)

Since the present invention employs the structure having the aforementioned movable member as discussed in the previous embodiments, the liquid ejecting head according to the present invention can eject the liquid at higher ejection power, at higher ejection efficiency, and at higher speed than the conventional liquid ejecting heads can. In the cases of the same liquid being used for the bubble generation liquid and the ejection liquid in the present embodiment, the liquid may be selected from various liquids as long as it is unlikely to be deteriorated by the heat applied by the heat generating element, it is unlikely to form a deposit on the heat generating element with application of heat, it is capable of undergoing reversible state changes between gasification and condensation with application of heat, and it is unlikely to deteriorate the liquid flow paths, the movable member, the partition wall, and so on.

Among such liquids, the liquid used for recording (recording liquid) may be one of the ink liquids of compositions used in the conventional bubble jet devices.

When the two-flow-path structure of the present invention is used with the ejection liquid and the bubble generation liquid of different liquids, the bubble generation liquid may be the liquid having the above-mentioned properties; specifically, it may be selected from methanol, ethanol, n-propanol, isopropanol, n-hexane, n-heptane, n-octane, toluene, xylene, methylene dichloride, trichlene, Freon TF, Freon BF, ethyl ether, dioxane, cyclohexane, methyl acetate, ethyl acetate, acetone, methyl ethyl ketone, water, and mixtures thereof.

The ejection liquid may be selected from various liquids, free from possession of bubble generation property and thermal property thereof. Further, the ejection liquid may be selected from liquids with low bubble generation property, ejection of which was difficult by the conventional heads, liquids likely to be modified or deteriorated by heat, and liquids with high viscosity.

However, the ejection liquid is preferably a liquid not to hinder ejection of liquid, generation of bubble, the operation of the movable member, and so on because of the ejection liquid itself or because of a reaction thereof with the bubble generation liquid.

For example, a high-viscosity ink may be used as the ejection liquid for recording. Other ejection liquids applicable includes liquids weak against heat such as pharmaceutical products and perfumes.

In the present invention recording was carried out using the ink liquid in the following composition as a recording liquid usable for the both ejection liquid and bubble generation liquid. Since the ejection speed of ink is increased by an improvement in the ejection power, the shot accuracy of liquid droplets is improved, which enables to obtain very good recording images.

| Composition of dye ink (viscosity 2 cP) | |
|---|---|
| (C. I. hood black 2) dye | 3 wt % |
| Diethylene glycol | 10 wt % |
| Thio diglycol | 5 wt % |
| Ethanol | 5 wt % |
| Water | 77 wt % |

Further, recording was also carried out with combinations of liquids in the following compositions for the bubble generation liquid and the ejection liquid. As a result, the head of the present invention was able to well eject not only the liquid with the viscosity of ten and several cP, which was not ejected by the conventional heads, but also even a liquid with a very high viscosity of 150 cP, thus obtaining high-quality recorded objects.

| Composition of bubble generation liquid 1 | |
|---|---|
| Ethanol | 40 wt % |
| Water | 60 wt % |

| Composition of bubble generation liquid 2 | |
|---|---|
| Water | 100 wt % |

| Composition of bubble generation liquid 3 | |
|---|---|
| Isopropyl alcohol | 10 wt % |
| Water | 90 wt % |

| Composition of pigment ink of ejection liquid 1 (viscosity approximately 15 cP) | |
|---|---|
| Carbon black | 5 wt % |
| Styrene-acrylic acid-ethyl acrylate copolymer (acid value 140 and weight average molecular weight 8000) | 1 wt % |
| Monoethanol amine | 0.25 wt % |
| Glycerine | 69 wt % |
| Thio diglycol | 5 wt % |

-continued

| Composition of pigment ink of ejection liquid 1 (viscosity approximately 15 cP) | |
|---|---|
| Ethanol | 3 wt % |
| Water | 16.75 wt % |

| Composition of ejection liquid 2 (viscosity 55 cP) | |
|---|---|
| Polyethylene glycol 200 | 100 wt % |

| Composition of ejection liquid 3 (viscosity 150 cP) | |
|---|---|
| Polyethylene glycol 600 | 100 wt % |

Incidentally, with the liquids conventionally considered as not readily be ejected as described above, the shot accuracy of dots was poor on the recording sheet because of the low ejection speed and increased variations in the ejection directionality, and unstable ejection caused variations of ejection amounts, which made it difficult to obtain high-quality images. Against it, the structures of the above embodiments realized satisfactory and stable generation of bubble using the bubble generation liquid. This resulted in an improvement in the shot accacy of droplets and stabilization of ink ejection amounts, thereby remarkably improving the quality of recording images.

(Structure of head of two-flow-path type)

Figure 19:
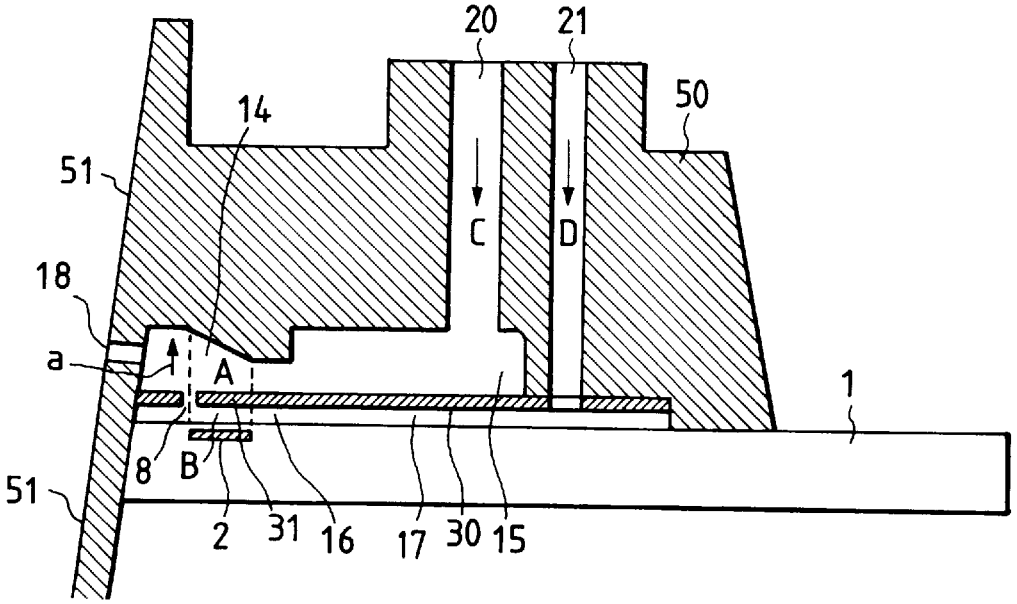
FIG. 19 is a sectional view of a supply passage of a liquid ejecting head in an embodiment of the present invention.
Figure 20:
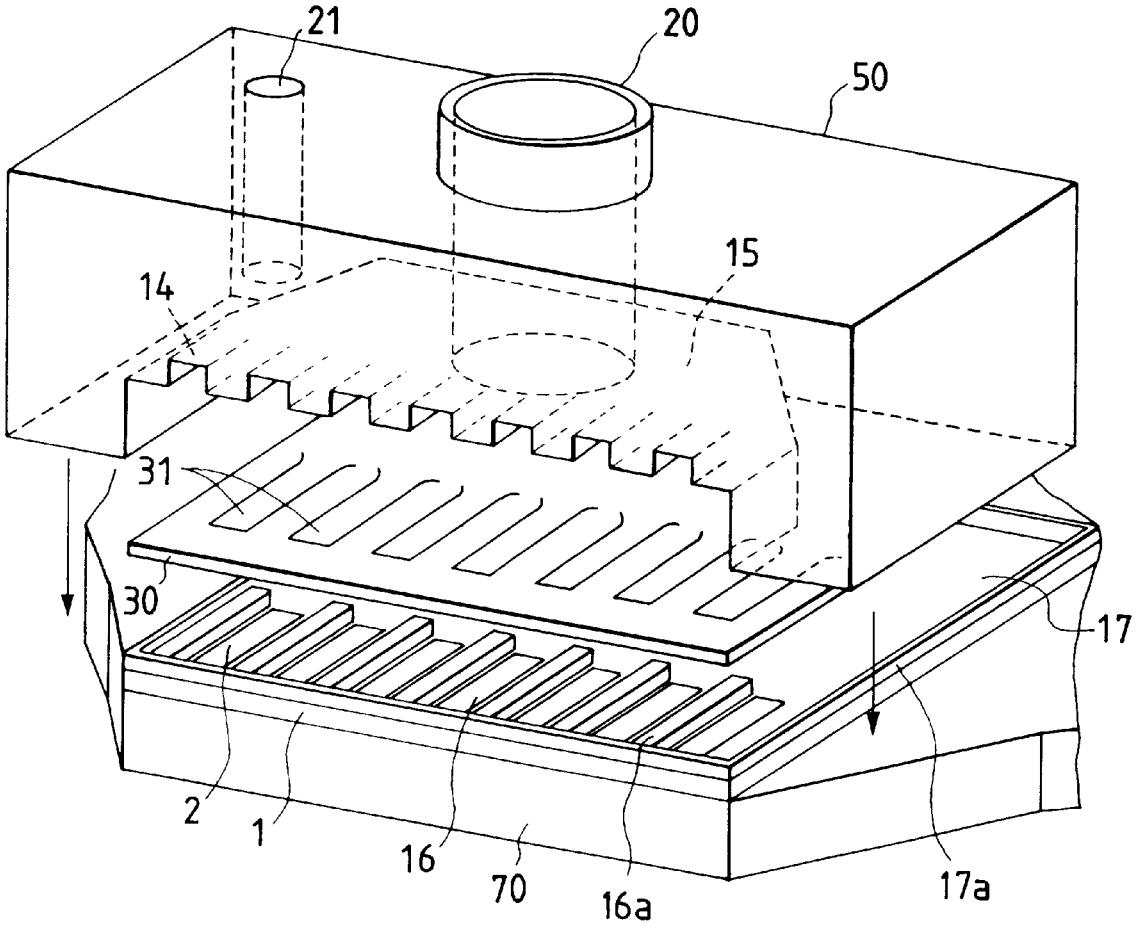
FIG. 20 is an exploded perspective view of a head of an embodiment of the present invention.

FIG. 19 and FIG. 20 are a sectional view and an exploded, perspective view, respectively, to show the structure of the whole of the head of the two-flow-path type out of the liquid ejecting heads of the present invention.

The aforementioned element substrate 1 is mounted on a support 70 of aluminum or the like. On the substrate there are provided walls 16*a* of the second liquid flow path 16 and walls 17*a* of the second common liquid chamber 17, on which the partition wall 30 having the movable member 31 is mounted. On this partition wall 30 there is provided a grooved member 50 having a plurality of grooves constituting the first liquid flow paths 14, the first common liquid chamber 15, a supply passage 20 for supplying the first liquid to the first common liquid chamber 15, and a supply passage 21 for supplying the second liquid to the second common liquid chamber 17. The liquid ejecting head of the two-flow-path type is constructed in this structure.

(Liquid ejection head cartridge)

Next explained schematically is a liquid ejection head cartridge incorporating the liquid ejecting head according to the above embodiment.

Figure 21:
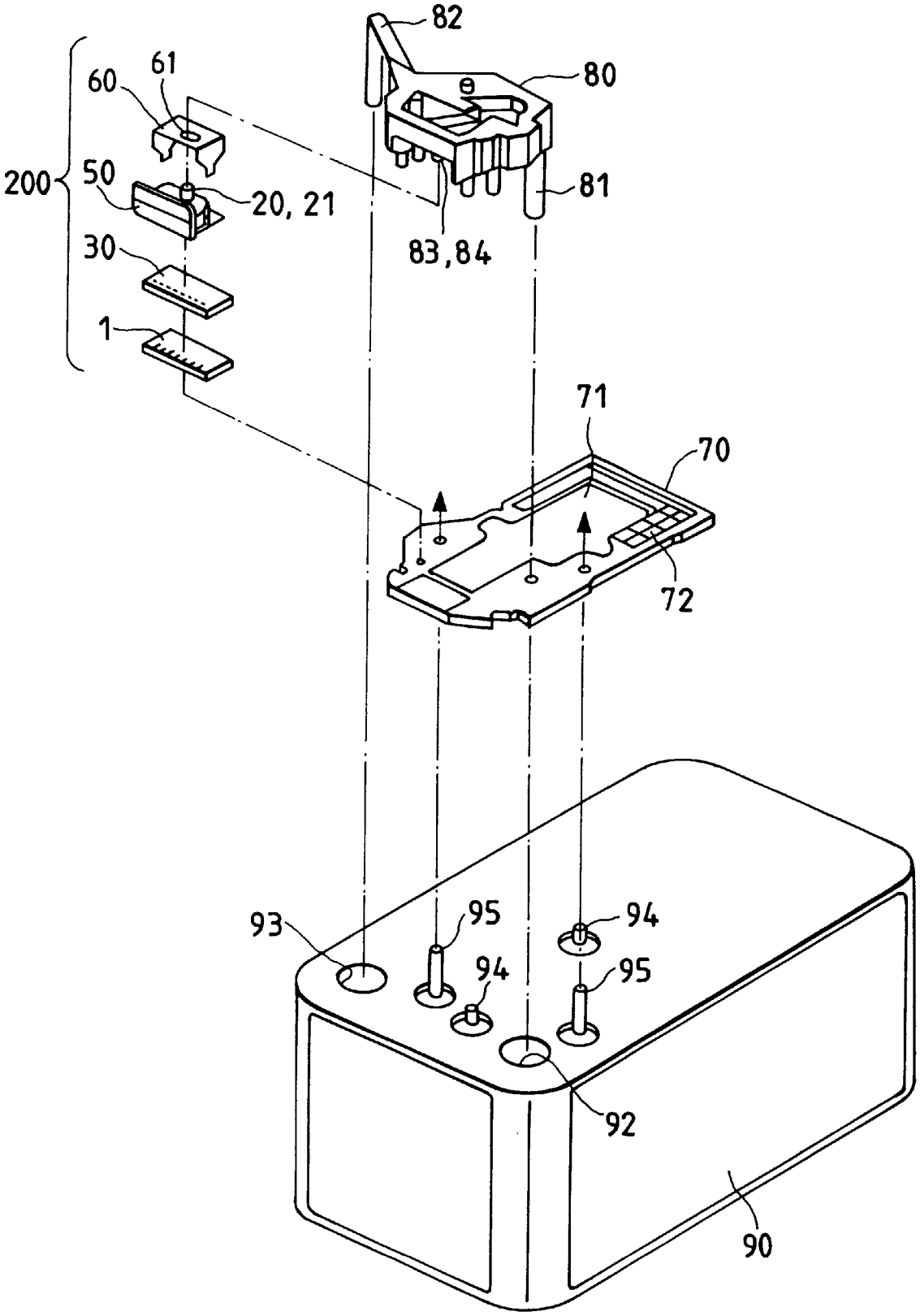
FIG. 21 is an exploded perspective view of a liquid ejection head cartridge.

FIG. 21 is a schematically exploded, perspective view of the liquid ejection head cartridge incorporating the liquid ejecting head as described above. The liquid ejection head cartridge is generally composed mainly of a liquid ejecting head portion 200 and a liquid container 90.

The liquid ejecting head portion 200 comprises an element substrate 1, a partition wall 30, a grooved member 50, a presser bar spring 60, a liquid supply member 80, and a support member 70. The element substrate 1 is provided with a plurality of arrayed heat generating resistors for supplying heat to the bubble generation liquid, as described previously. Further, there are provided a plurality of function elements for selectively driving the heat generating resistors. Bubble generation liquid passages are formed between the element substrate 1 and the aforementioned partition wall 30 having the movable walls, thereby allowing the bubble generation liquid to flow therein. This partition wall 30 is joined with the grooved member 50 to form ejection flow paths (not shown) through which the ejection liquid to be ejected flows.

The presser bar spring 60 is a member which acts to exert an urging force toward the element substrate 1 on the grooved member 50, and this urging force properly incorporates the element substrate 1, the partition wall 30, the grooved member 50, and the support member 70 detailed below.

The support member 70 is a member for supporting the element substrate 1 etc. Mounted on this support member 70 are a circuit board 71 connected to the element substrate 1 to supply an electric signal thereto, and contact pads 72 connected to the apparatus side to effect communication of electric signals with the apparatus side.

The liquid container 90 separately contains the ejection liquid such as ink to be supplied to the liquid ejecting head and the bubble generation liquid for generation of bubble inside. Outside the liquid container 90 there are a positioning portion 94 for positioning a connecting member for connecting the liquid ejecting head with the liquid container, and a fixed shaft 95 for fixing the connection portion. The ejection liquid is supplied from an ejection liquid supply passage 92 of the liquid container through a supply passage of the connecting member to an ejection liquid supply passage 81 of the liquid supply member 80 and then is supplied through ejection liquid supply passages 84, 61, 20 of respective members to the first common liquid chamber. The bubble generation liquid is similarly supplied from a supply passage 93 of the liquid container through a supply passage of the connecting member to a bubble generation liquid supply passage 82 of the liquid supply member 80 and then is supplied through bubble generation liquid supply passages 84, 61, 21 of respective members to the second liquid chamber.

The above liquid ejection head cartridge was explained with the supply mode and liquid container permitting supply of different liquids of the bubble generation liquid and the ejection liquid, but, if the ejection liquid and the bubble generation liquid are of the same liquid, there is no need to separate the supply passages and container for the bubble generation liquid and the ejection liquid.

This liquid container may be refilled with a liquid after either liquid is used up. For this purpose, the liquid container is desirably provided with a liquid injection port. The liquid ejecting head may be arranged as integral with or separable from the liquid container.

(Liquid ejecting device)

Figure 22:
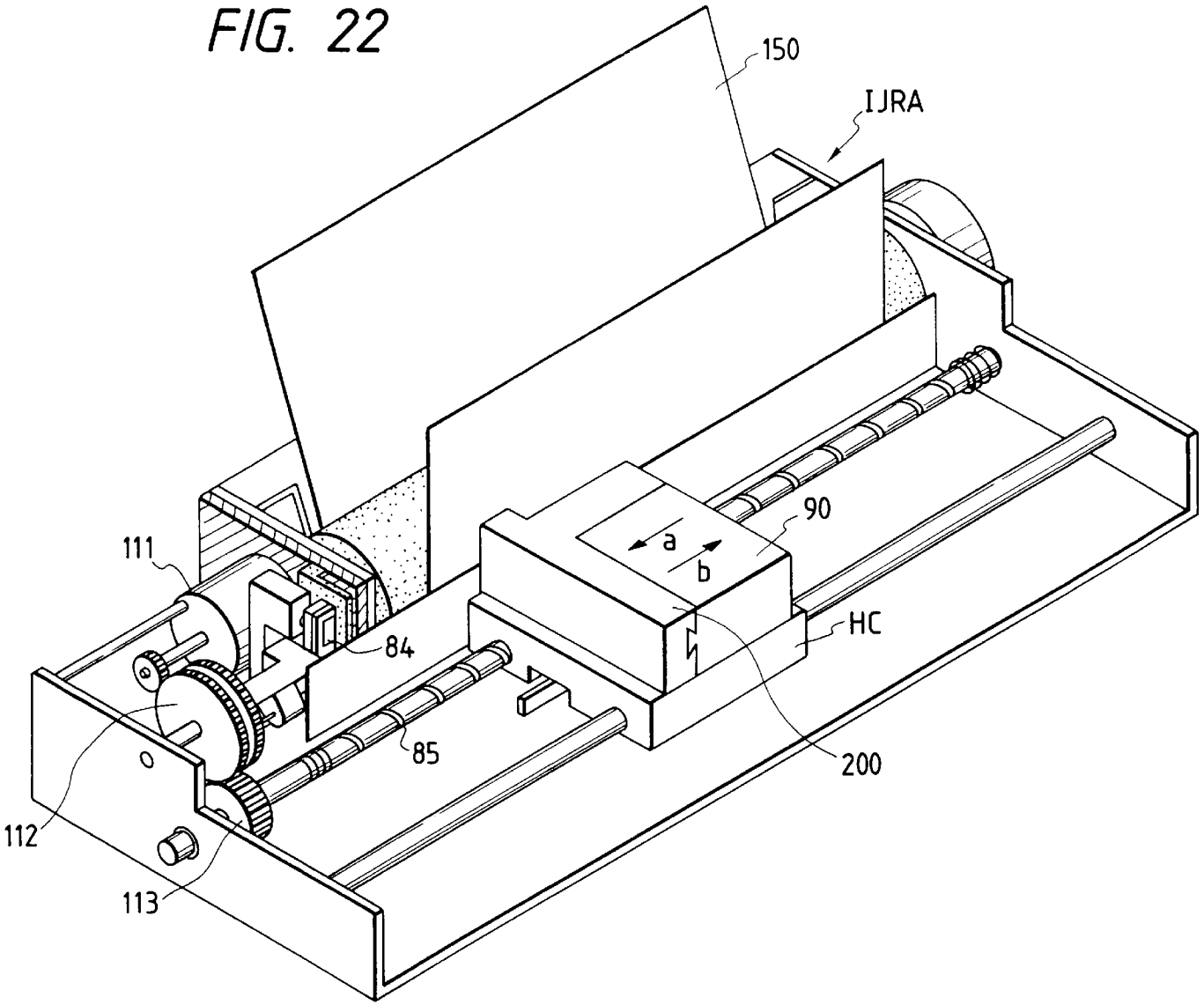
FIG. 22 is a schematic illustration of a liquid ejecting device.

FIG. 22 shows the schematic structure of the liquid ejecting device incorporating the liquid ejecting head described previously. The present embodiment will be explained especially with an ink ejection recording apparatus using the ink as the ejection liquid. A carriage HC of the liquid ejecting device carries a head cartridge on which a liquid tank portion 90 containing the ink and a liquid ejection head portion 200 are detachably mounted, and reciprocally moves widthwise of a recording medium 150 such as a recording sheet conveyed by a recording medium conveying means.

When a driving signal is supplied from a driving signal supply means not shown to the liquid ejecting means on the carriage, the recording liquid is ejected from the liquid ejecting head to the recording medium in response to this signal.

The liquid ejecting apparatus of the present embodiment has a motor 111 as a driving source for driving the recording medium conveying means and the carriage, and gears 112, 113 and a carriage shaft 115 for transmitting the power from the driving source to the carriage. By this recording apparatus and liquid ejecting method therewith, recorded articles with good images were able to be attained by ejecting the liquid to various recording media.

Figure 23:
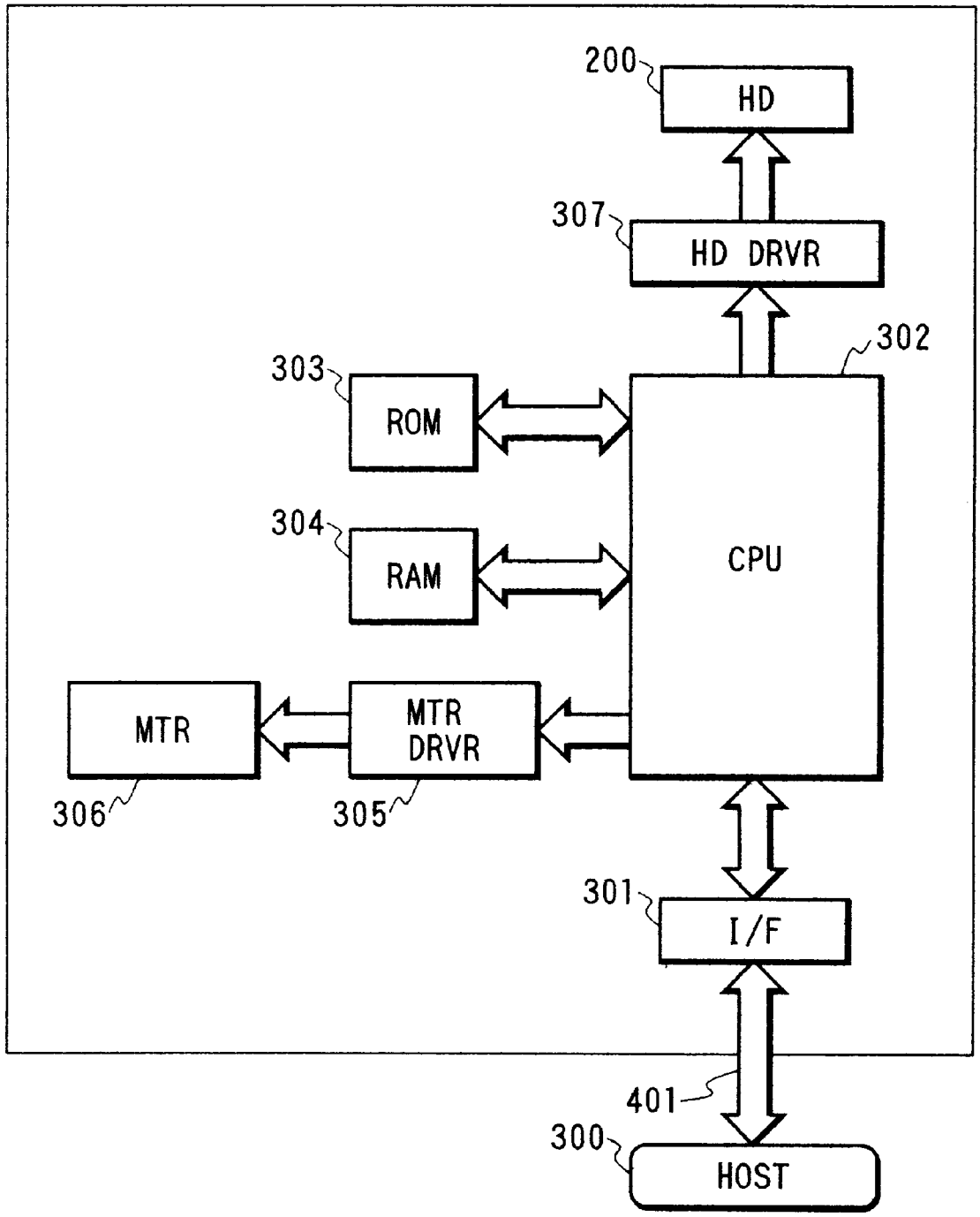
FIG. 23 is a block diagram of an apparatus.

FIG. 23 is a block diagram of the entire apparatus for operating the ink ejecting apparatus to which the liquid ejecting method and liquid ejecting head of the present invention are applied.

The recording apparatus receives printing information as a control signal from a host computer 300. The printing information is temporarily stored in an input interface 301 inside a printing apparatus, and, at the same time, is converted into data processable in the recording apparatus. This data is input to a CPU 302 also serving as a head driving signal supply means. The CPU 302 processes the data thus received, using peripheral units such as RAM 304, based on a control program stored in ROM 303 in order to convert the data into printing data (image data).

In order to record the image data at an appropriate position on a recording sheet, the CPU 302 generates driving data for driving the driving motor for moving the recording sheet and recording head in synchronization with the image data. The image data and motor driving data is transmitted each through a head driver 307 and a motor driver 305 to a head and a drive motor 306, respectively, which are driven at respective controlled timings to form an image.

Examples of the recording media applicable to the above recording apparatus and recorded with the liquid such as ink include the following: various types of paper; OHP sheets; plastics used for compact disks, ornamental plates, or the like; fabrics; metals such as aluminum and copper; leather materials such as cowhide, pigskin, and synthetic leather; lumber materials such as solid wood and plywood; bamboo material; ceramics such as tile; and three-dimensional structures such as sponge.

The aforementioned recording apparatus includes a printer apparatus for recording on various types of paper and OHP sheet, a plastic recording apparatus for recording on a plastic material such as a compact disk, a metal recording apparatus for recording on a metal plate, a leather recording apparatus for recording on a leather material, a wood recording apparatus for recording on wood, a ceramic recording apparatus for recording on a ceramic material, a recording apparatus for recording on a three-dimensional network structure such as sponge, a textile printing apparatus for recording on a fabric, and so on.

The ejection liquid used in these liquid ejecting apparatus may be properly selected as a liquid matching with the recording medium and recording conditions employed.

(Recording system)

Next explained is an example of the ink jet recording system using the liquid ejecting head of the present invention as a recording head and performing recording on a recording medium.

Figure 24:
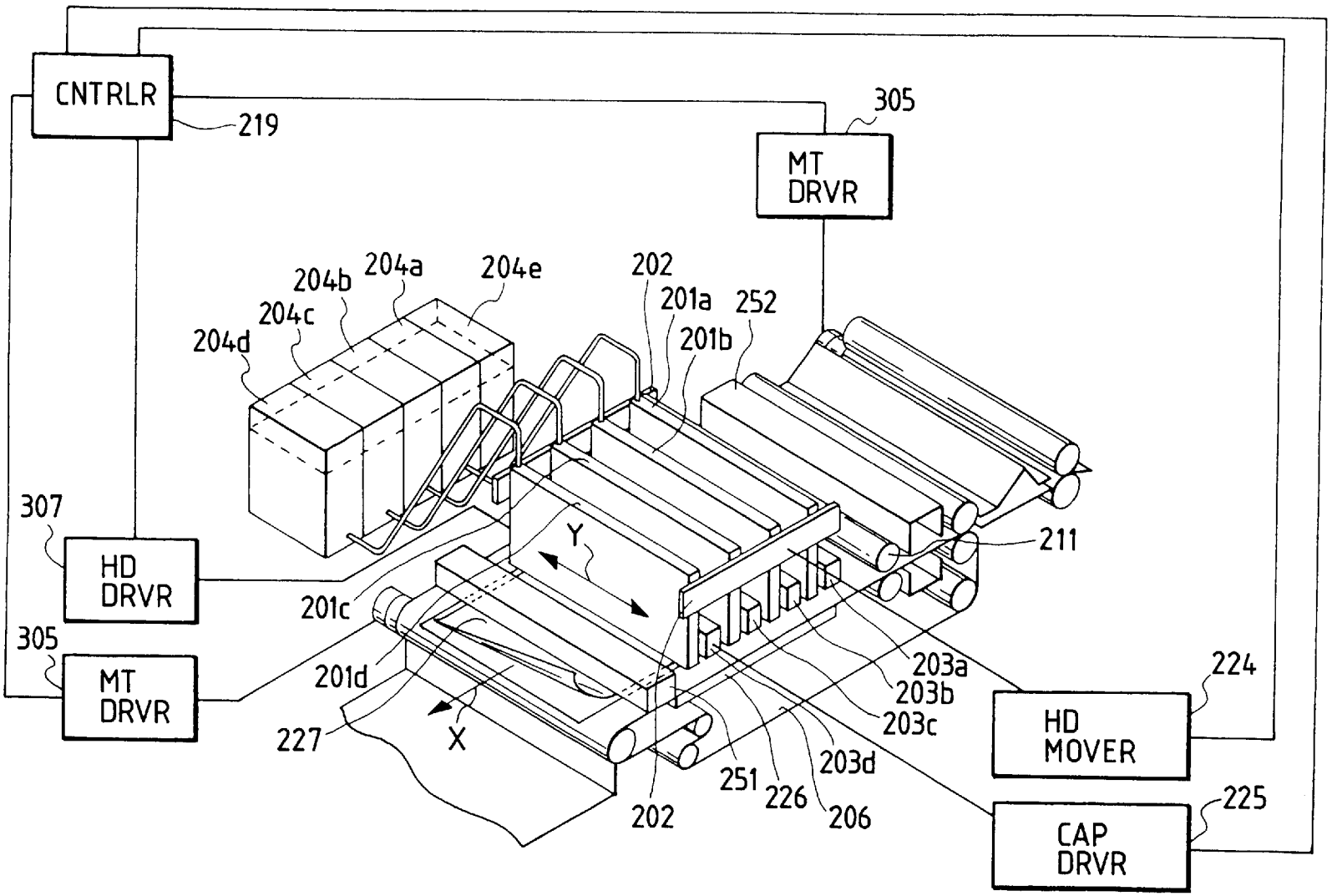
FIG. 24 is a schematic view of a liquid ejection recording system.

FIG. 24 is a schematic drawing for explaining the structure of the ink jet recording system using the liquid ejecting head 201 of the present invention described above. The liquid ejecting head in the present embodiment is a full-line head having a plurality of ejection outlets aligned in the density of 360 dpi so as to cover the entire recordable range of the recording medium 150. The liquid ejecting head comprises four head units corresponding to four colors of yellow (Y), magenta (M), cyan (C), and black (Bk), which are fixedly supported in parallel with each other and at predetermined intervals in the X-direction.

A head driver 307 constituting a driving signal supply means supplies a signal to each of these head units to drive each head unit, based on this signal.

The four color inks of Y, M, C, and Bk are supplied as the ejection liquid to the associated heads from corresponding ink containers 2041a–204*d*. Reference numeral 204*e* designates a bubble generation liquid container containing the bubble generation liquid, from which the bubble generation liquid is supplied to each head unit.

Disposed below each head is a head cap 203*a*, 203*b*, 203*c*, or 203*d* containing an ink absorbing member comprised of sponge or the like inside. The head caps cover the ejection outlets of the respective heads during non-recording periods so as to protect and maintain the head units.

Reference numeral 206 denotes a conveyer belt constituting a conveying means for conveying a recording medium selected from the various types of media as explained in the preceding embodiments. The conveyer belt 206 is routed in a predetermined path via various rollers and is driven by a driving roller connected to a motor driver 305.

The ink jet recording system of this embodiment comprises a pre-processing apparatus 251 and a post-processing apparatus 252, disposed upstream and downstream, respectively, of the recording medium conveying path, for effecting various processes on the recording medium before and after recording.

The pre-processing and post-processing may include different processing contents depending upon the type of recording medium and the type of ink used in recording. For example, when the recording medium is one selected from metals, plastics, and ceramics, the pre-processing may be exposure to ultraviolet rays and ozone to activate the surface thereof, thereby improving adhesion of ink. If the recording medium is one likely to have static electricity such as plastics, dust is easy to attach to the surface because of the static electricity, and this dust sometimes hinders good recording. In that case, the pre-processing may be elimination of static electricity in the recording medium using an ionizer, thereby removing the dust from the recording medium. If the recording medium is a fabric, the pre-processing may be a treatment of application of a material selected from alkaline substances, water-soluble substances, synthetic polymers, water-soluble metal salts, urea, and thiourea to the fabric in order to prevent blot and to improve the deposition rate. The pre-processing does not have to be limited to these, but may be any processing, for example processing to adjust the temperature of the recording medium to a temperature suitable for recording.

On the other hand, the post-processing may be, for example, heat processing of the recording medium with the ink deposited, fixing processing for promoting fixation of the ink by irradiation with ultraviolet rays or the like, processing for washing away a treatment agent given in the pre-processing and remaining without reacting.

The present embodiment was explained using the full-line head as the ejecting head, but, without having to be limited to this, the head may be a compact head for effecting recording as moving in the widthwise direction of the recording medium, as described previously.

(Head kit)

Figure 25:
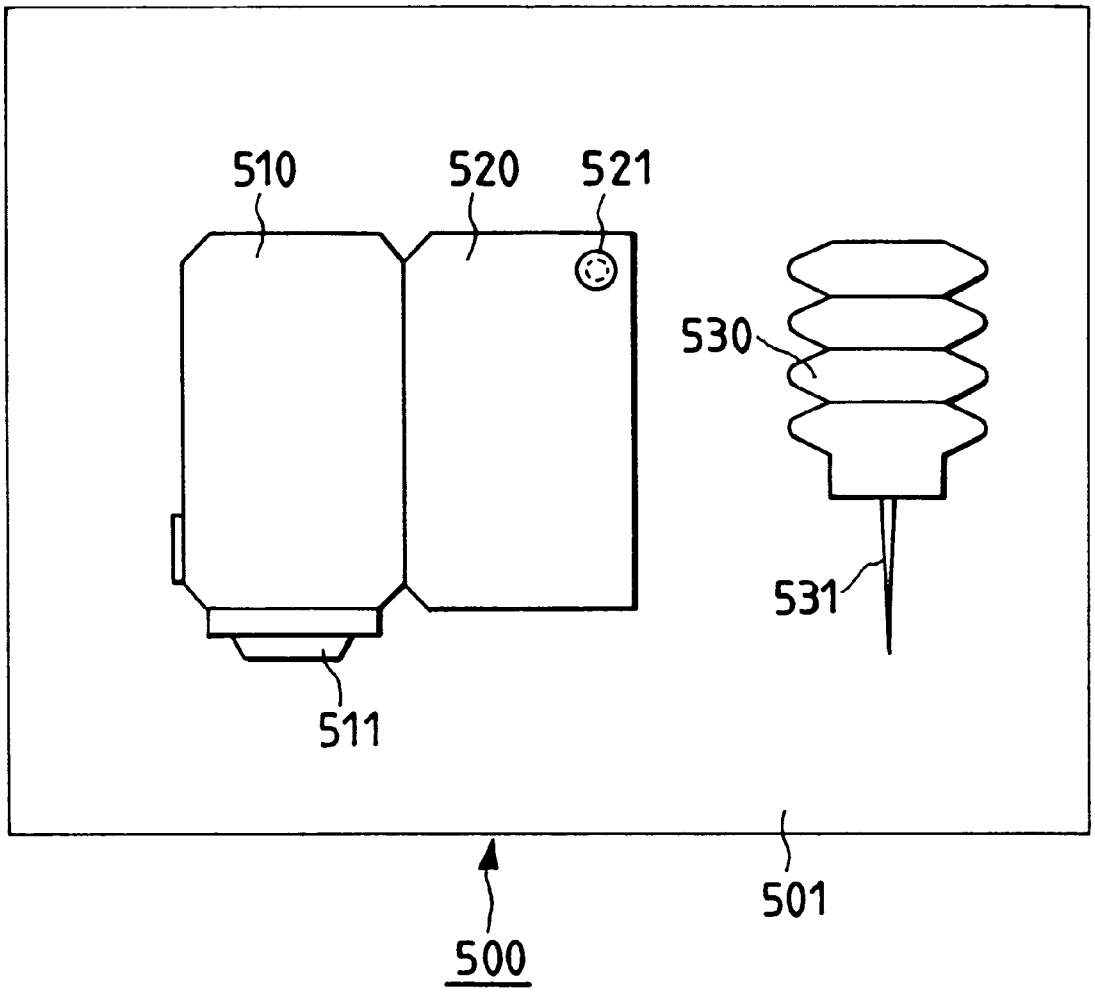
FIG. 25 is a schematic view of a head kit.

Next explained is an ink jet head kit having the ink jet head of the present invention. FIG. 25 is a schematic drawing to show such an ink jet head kit. This ink jet head kit is composed of an ink jet head 510 of the present invention having an ink ejection portion 511 for ejecting the ink, an ink container 520 as a liquid container integral with or separable from the head, and an ink filling means 530 containing the ink to fill the ink in the ink container, housed in a kit container 501.

After the ink is used up, a part of an injection portion (hypodermic needle or the like) 531 of the ink filling means 530 is inserted into an air vent 521 of the ink container, a connecting portion to the ink jet head, or a hole perforated through an wall of the ink container, and the ink in the ink filling means is filled into the ink container through the injection portion.

Employing the arrangement of the kit housing the ink jet head of the present invention and the ink container and ink filling means in a single kit container in this manner, the ink can be readily filled in the ink container soon after the ink is used up, and recording is restarted quickly.

Although the ink jet head kit of the present embodiment was explained as an ink jet head kit including the ink filling means, it may be constructed without the ink filling means in an arrangement of the head and the ink container of a separable type filled with ink, housed in the kit container 510.

FIG. 25 shows only the ink filling means for filling the ink into the ink container, but another head kit may also have a bubble generation liquid filling means for filling the bubble generation liquid into the bubble generation liquid container, in the kit container, as well as the ink container.

The present invention accomplished the further more stabilized ejection state of liquid by properly specifying the maximum displacement angle when the movable member, fundamentally controlling the bubble generated in the liquid flow path, is displaced at maximum by generation of bubble with respect to the angle of the straight line connecting the fulcrum portion of the movable member with the intersecting point of the center axis of ejection outlet with the surface of the ejection outlet connected to the liquid flow path from the reference of the standby position of the movable member. Particularly, the present invention solved the problem of variations of ejection state due to variations of configuration of ejection outlet between heads or between nozzles caused by the factor of manufacturing variations in forming the ejection outlet with laser or the like, thereby achieving very high stability.

In addition to the above-described effects, the liquid ejecting method, head, and so on according to the present invention, based on the novel ejection principle using the movable member, can attain the synergistic effect of the bubble generated and the. movable member displaced thereby, so that the liquid near the ejection outlet can be efficiently ejected, thereby improving the ejection efficiency as compared with the conventional ejection methods, heads, and so on of the bubble jet method.

With the characteristic structures of the present invention, ejection failure can be prevented even after long-term storage at low temperature or at low moisture, or, even if ejection failure occurs, the head can be advantageously returned instantly into a normal condition only with a recovery process such as preliminary ejection or suction recovery. With this advantage, the invention can reduce the recovery time and losses of the liquid due to recovery, and thus can greatly decrease the running cost.

Especially, the structures of the present invention improving the refilling characteristics attained improvements in responsivity upon continuous ejection, stable growth of bubble, and stability of liquid droplet, thereby enabling high-speed recording or high-quality recording based on high-speed liquid ejection.

In the head of the two-flow path structure the freedom of selection of the ejection liquid was raised because the bubble generation liquid applied was a liquid likely to generate a bubble or a liquid unlikely to form a deposit (scorch or the like) on the heat generating element. It was confirmed that the head of the two-flow path structure was able to well eject even the liquid that the conventional heads failed to eject in the conventional bubble jet ejection method, for example, a high-viscosity liquid unlikely to generate a bubble, a liquid likely to form a deposit on the heat generating element, an so on.

Further, it was confirmed that the head of the two-flow path structure was able to eject even a liquid weak against heat or the like without causing a negative effect on the ejection liquid.

When the liquid ejecting head of the present invention was used as a liquid ejection recording head for recording, further higher-quality recording was achieved.

The invention provided the liquid ejecting apparatus, recording system, and so on further improved in the ejection efficiency of liquid or the like, using the liquid ejecting head of the present invention.

Use or reuse of the head can be readily achieved using the head cartridge or the head kit of the present invention.

What is claimed is:

1. A liquid ejecting method for ejecting a liquid, comprising:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to said ejection outlet portion than a fulcrum portion thereof, and displacing said movable member by a pressure based on generation of the bubble from a position of a reference surface to a position of a maximum displacement, thereby ejecting the liquid, wherein a relation of $(2\theta_E-5°)\leqq\theta_M\leqq(2\theta_E+5°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle.

2. A liquid ejecting method according to claim 1, wherein the angle $\theta_M$ of said movable member at the maximum displacement is set to be not less than an angle of a line connecting said fulcrum portion with an uppermost end of the ejection outlet portion of said connecting surface with respect to the reference surface.

3. A liquid ejecting method according to claim 1, wherein the angle $\theta_M$ of the movable member at the maximum displacement is set to be $2\theta_E\leqq\theta_M$.

4. A liquid ejecting method according to any one of claim 1, claim 2, and claim 3, wherein by displacement of the movable member said bubble is expanded more downstream than upstream in a direction directed toward the ejection outlet, thereby ejecting the liquid.

5. A liquid ejecting method comprising:

using a liquid ejecting head having an ejection outlet portion having an ejection outlet for ejecting a liquid, a first liquid flow path in fluid communication with said ejection outlet portion, a second liquid flow path having a bubble generation region, and a movable member disposed to face said bubble generation region and provided with a free end closer to the ejection outlet portion than a fulcrum portion thereof, generating a bubble in said bubble generation region, and displacing said movable member by a pressure based on generation of the bubble from a position of a reference surface to a position of a maximum displacement, thereby ejecting the liquid, wherein a relation of $(2\theta_E-5°)\leqq\theta_M\leqq(2\theta_E+5°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle.

6. A liquid ejecting method according to claim 5, wherein the angle $\theta_M$ of said movable member at the maximum displacement is set to be not less than an angle of a line connecting said fulcrum portion with an uppermost end of the ejection outlet portion of said connecting surface with respect to the reference surface.

7. A liquid ejecting method according to claim 5, wherein the angle $\theta_M$ of the movable member at the maximum displacement is set to be $2\theta_E \leqq \theta_M$.

8. A liquid ejecting method according to any one of claim 5, claim 6, and claim 7, wherein the head used in said method ejects the liquid by expanding said bubble more downstream than upstream in a direction toward the ejection outlet by displacement of the movable member.

9. A liquid ejecting method comprising:

using a liquid ejecting head having an ejection outlet portion having an ejection outlet for ejecting a liquid, a first liquid flow path in fluid communication with said ejection outlet portion, a second liquid flow path having a bubble generation region, and a movable member disposed to face said bubble generation region and provided with a free end closer to the ejection outlet portion than a fulcrum portion thereof, generating a bubble in said bubble generation region, and displacing said movable member by a pressure based on generation of the bubble from a position of a reference surface to a position of a maximum displacement, thereby ejecting the liquid, wherein a relation of $(2\theta_E-7°) \leqq \theta_M \leqq (2\theta_E+7°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle.

10. A liquid ejecting method according to claim 9, wherein a liquid supplied to said first liquid flow path and a liquid supplied to said second liquid flow path are a same liquid.

11. A liquid ejecting method according to claim 9, wherein a liquid supplied to said first liquid flow path and a liquid supplied to said second liquid flow path are different liquids.

12. A liquid ejecting method according to any one of claim 9, claim 10, and claim 11, wherein the angle $\theta_M$ of said movable member at the maximum displacement is set to be not less than an angle of a line connecting said fulcrum portion with an uppermost end of the ejection outlet portion of said connecting surface with respect to the reference surface.

13. A liquid ejecting method according to any one of claim 9, claim 10, and claim 11, wherein the angle $\theta_M$ of the movable member at the maximum displacement is set to be $2\theta_E \leqq \theta_M$.

14. A liquid ejecting method according to any one of claim 9, claim 10, and claim 11, wherein by displacement of the movable member said bubble is expanded more downstream than upstream in a direction directed toward the ejection outlet, thereby ejecting the liquid.

15. A liquid ejecting method for ejecting a liquid, comprising:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to said ejection outlet portion than a fulcrum portion thereof, and displacing said movable member by a pressure based on generation of the bubble from a position of a reference surface to a position of a maximum displacement, thereby ejecting the liquid, wherein a relation of $\theta_M \leqq (2\theta_E+5°)$ is satisfied where, with a reference of said reference surface, $\theta_M$ is an angle of said movable member at said maximum displacement thereof about said fulcrum portion and $\theta_M$ is an angle of an axis connecting said fulcrum portion with an intersecting point of a center axis of said ejection outlet with a connecting surface of said ejection outlet portion to said liquid flow path, and wherein $\theta_M$ is an acute angle and is not less than an angle of an axis connecting said fulcrum portion with an uppermost end of the ejection outlet portion of said connecting surface.

16. A liquid ejecting method for ejecting a liquid, comprising:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to said ejection outlet portion than a fulcrum portion thereof, and displacing said movable member by a pressure based on generation of the bubble from a position of a reference surface to a position of a maximum displacement, thereby ejecting the liquid, wherein a relation of $(2\theta_E-5°) \leqq \theta_M \leqq 2\theta_E$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle and is not less than an angle of an axis connecting said fulcrum portion with an uppermost end of the ejection outlet portion of said connecting surface.

17. A liquid ejecting method according to any one of claims 1, 5, and 9, wherein a height of a ceiling of the liquid flow path in fluid communication with said ejection outlet portion above said free end is higher than that above said fulcrum portion.

18. A liquid ejecting method according to any one of claims 1, 5, and 9, wherein a heat generating element for generating a bubble is disposed on a side opposed to said movable member and a space between the movable member and the heat generating element is the bubble generation region.

19. A liquid ejecting head for ejecting a liquid, comprising:

an ejection outlet portion having an ejection outlet for ejecting the liquid, a liquid flow path in fluid communication with said ejection outlet portion, a bubble generation region for generating a bubble in the liquid, and a movable member disposed to face the bubble generation region and provided with a free end closer to said ejection outlet portion than a fulcrum portion thereof, wherein, upon displacing said movable member by a pressure based on generation of the bubble from a position of a reference surface to a position of a maximum displacement to eject the liquid, a relation of $(2\theta_E-5°) \leqq \theta_M \leqq (2\theta_E+5°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle.

20. A liquid ejecting head comprising:

an ejection outlet portion having an ejection outlet for ejecting a liquid, a first liquid flow path in fluid communication with the ejection outlet portion, a second liquid flow path having a bubble generation region, and a movable member disposed to face the bubble generation region and provided with a free end closer to the ejection outlet portion than a fulcrum portion thereof, wherein, upon generating a bubble in said bubble generation region and displacing said movable member by a pressure based on the generation of the bubble from a position of a reference surface to a position of a maximum displacement to eject the liquid, a relation of $(2\theta_E-5°)\leqq\theta_M\leqq(2\theta_{E+5}°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle.

21. A liquid ejecting head comprising:

an ejection outlet portion having an ejection outlet for ejecting a liquid, a first liquid flow path in fluid communication with the ejection outlet portion, a second liquid flow path having a bubble generation region, and a movable member disposed to face the bubble generation region and provided with a free end closer to the ejection outlet portion than a fulcrum portion thereof, wherein, upon generating a bubble in said bubble generation region and displacing said movable member by a pressure based on the generation of the bubble from a position of a reference surface to a position of a maximum displacement to eject the liquid, a relation of $(2\theta_E-7°)\leqq\theta_M\leqq(2\theta_E+7°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_m$ is an acute angle.

22. A liquid ejecting head for ejecting a liquid, comprising:

an ejection outlet portion having an ejection outlet for ejecting the liquid, a liquid flow path in fluid communication with said ejection outlet portion, a bubble generation region for generating a bubble in the liquid, and a movable member disposed to face the bubble generation region and provided with a free end closer to said ejection outlet portion than a fulcrum portion thereof, in which said movable member is displaced by a pressure based on generation of a bubble from a position of a reference surface to a position of a maximum displacement to eject the liquid, wherein a relation of $\theta_M\leqq(2\theta_E+7°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle and is not less than an angle of an axis connecting said fulcrum portion with an uppermost end of the ejection outlet portion of said connecting surface.

23. A liquid ejecting head for ejecting a liquid, comprising:

an ejection outlet portion having an ejection outlet for ejecting the liquid, a liquid flow path in fluid communication with said ejection outlet portion, a bubble generation region for generating a bubble in the liquid, and a movable member disposed to face the bubble generation region and provided with a free end closer to said ejection outlet portion than a fulcrum portion thereof, in which said movable member is displaced by a pressure based on generation of a bubble from a position of a reference surface to a position of a maximum displacement to eject the liquid, wherein a relation of $(2\theta_E-5°)\leqq\theta_M\leqq2\theta_E$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle and is not less than an angle of an axis connecting said fulcrum portion with an uppermost end of the ejection outlet portion of said connecting surface.

24. A liquid ejecting head according to any one of claims 19, 20, 21, 22, and 23, wherein a height of a ceiling of the liquid flow path in fluid communication with said ejection outlet portion above said free end is higher than that above said fulcrum portion.

25. A liquid ejecting head according to any one of claims 19, 20, 21, 22, and 23, wherein a heat generating element is disposed on a side opposed to said movable member and a space between the movable member and the heat generating element is the bubble generation region.

26. A liquid ejecting apparatus for ejecting a liquid by generation of a bubble, comprising:

the liquid ejecting head as set forth in any one of claims 19, 20, 21, 22, and 23; and driving signal supply means for supplying a driving signal for ejecting the liquid from said liquid ejecting head.

27. A liquid ejecting apparatus for ejecting a liquid by generation of a bubble, comprising:

the liquid ejecting head as set forth in any one of claims 19, 20, 21, 22, and 23; and recording medium conveying means for conveying a recording medium for receiving the liquid ejected from said liquid ejecting head.

28. A liquid ejecting method for ejecting a liquid, comprising the steps of:

using a liquid ejecting head having an ejection outlet portion having an ejection outlet for ejecting the liquid, a liquid flow path in fluid communication with the ejection outlet portion, a bubble generation region for generating a bubble in the liquid, and a movable member disposed to face the bubble generation region and provided with a free end closer to said ejection outlet portion than a fulcrum portion thereof, and displacing said movable member by a pressure based on generation of the bubble from a position of reference surface to a position of a maximun displacement, thereby ejecting the liquid, wherein a relationship of $(2\theta_E-7°)\leqq\theta_M\leqq(2\theta_E+7°)$ is satisfied where, with a reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle.

29. A liquid ejecting method according to claim 28, wherein the angle $\theta_M$ of the movable member at the maximum displacement is set to be $(2\theta_E-5°)\leqq\theta_M\leqq(2\theta_E+5°)$.

30. A liquid ejecting method according to claim 28 or 29, wherein the angle $\theta_M$ of the movable member at the maximum displacement is set to be $(2\theta_E-5°)\leqq\theta_M\leqq(2\theta_E)$.

31. A liquid ejecting method according to claim 28 or 29, wherein the angle $\theta_M$ of the movable member at the maximum displacement is set to be $\theta_M\leqq(2\theta_E+5°)$

32. A liquid ejecting method as claimed in any one of claims 28 or 29, wherein the angle $\theta_M$ of the movable member at the maximum displacement is set to be $2\theta_E\leqq\theta_M$.

33. A liquid method ejecting as claimed in claims 28 or 29, wherein said liquid ejecting head is provided with a first liquid flow path for forming a liquid flow path communicated with said ejection outlet portion and a second liquid flow path having said bubble generation area.

34. A liquid ejecting method as claimed in claim 33, wherein a liquid supplied to said first liquid flow path and a liquid supplied to said second liquid flow path are a same liquid.

35. A liquid ejecting method as claimed in claim 33, wherein a liquid supplied to said first liquid flow path and a liquid supplied to said second liquid flow path are different liquids.

36. A liquid ejecting method as claimed in claims 28 or 29, wherein the angle $\theta_M$ of said movable member at the maximum displacement is set to be not less than an angle of a line connecting said fulcrum portion with an uppermost end of the ejection outlet portion of said connecting surface with respect to the reference surface.

37. A liquid ejecting method as claimed in of claims 28 or 29, wherein displacement of the movable member said bubble is expanded more downstream than upstream in a direction directed toward the ejection outlet, thereby ejecting the liquid.

38. A liquid ejecting method as claimed in of claims 28 or 29, wherein a height of a ceiling of the liquid flow path in fluid communication with said ejection outlet portion above said free end is higher than that above said fulcrum portion.

39. A liquid ejecting method as claimed in claims 28 or 29, wherein a heat generating element for generating a bubble is disposed on a side opposed to said movable member and a space between the movable member and the heat generating element is the bubble generation region.

40. A liquid ejecting head for ejecting a liquid, comprising:

an ejection outlet portion having an ejection outlet for ejecting the liquid, a liquid flow path in fluid communication with said ejection outlet portion, a bubble generation region for generationg a bubble in the liquid, and a movable member disposed to face the bubble generation region and provided with a free end closer to said ejection outlet portion than a fulcrum portion thereof, wherein, upon displacing said movable member by a pressure based on generation of the bubble from a position of a reference surface to a position of a maximum displacement to eject the liquid.

a relation of $(2\theta_E-7°)\leqq\theta_M\leqq(2\theta_E+7°)$ is satisfied where, with reference of said reference surface, $\theta_M$ is an angle of said movable member at said maximum displacement thereof about said fulcrum portion and $\theta_E$ is an angle of an axis connecting said fulcrum portion with an intersecting point of a center axis of said ejection outlet with a connecting surface of said ejection outlet portion to said liquid flow path, and wherein $\theta_M$ is an acute angle.

41. A liquid ejecting head as claimed in claim 40, wherein the angle $\theta_M$ of the movable member at the maximum displacement is set to be $(2\theta_E-5°)\leqq\theta_M\leqq(2\theta_E+5°)$.

42. A liquid ejecting head as claimed in claims 40 or 41, wherein the angle $\theta_M$ of the movable member at the maximum displacement is set to be $(2\theta_E-5°)\leqq\theta_M\leqq(2\theta_E)$.

43. A liquid ejecting head as claimed in claims 40 or 41, wherein the angle $\theta_M$ of the movable member at the maximum displacement is set to be $\theta_M\leqq(2\theta_E+5°)$.

44. A liquid ejecting head as claimed in claims 40 or 41, wherein said liquid ejecting head is provided with a first liquid flow path for forming a liquid flow path communicated with said ejection outlet portion and a second liquid flow path having said bubble generation area.

45. A liquid ejecting head as claimed in claims 40 or 41, wherein a height of a ceiling of the liquid flow path in fluid communication with said ejection outlet portion above said free end is higher than that above said fulcrum portion.

46. A liquid ejecting head as claimed in any one of claims 40 or 41, wherein a heat generating element is disposed on a side opposed to said movable member and a space between the movable member and the heat generating element is the bubble generation region.

47. A liquid ejecting apparatus for ejecting a liquid by generation of a bubble, the apparatus comprising:

the liquid ejecting head as claimed in claims 40 or 41; and driving signal supply means for supplying a driving signal for ejecting the liquid from said liquid ejecting head.

48. A liquid ejecting apparatus for ejecting a liquid by generation of a bubble, the apparatus comprising:

the liquid ejecting head as claimed in claims 40 or 41; and recording medium conveying means for conveying a recording medium for receiving the liquid ejected from said liquid ejecting head.

* * * * *

UNITED STATES PATENT AND TRADEMARK OFFICE

CERTIFICATE OF CORRECTION

PATENT NO. : 6,102,529

DATED : August 15, 2000

INVENTOR(S) : TAKESHI OKAZAKI ET AL.

It is certified that error appears in the above-identified patent and that said Letters Patent is hereby corrected as shown below:

COLUMN 1

Line 5, "08/638.326" should read --08/638,326--;

COLUMN 17

Line 58, "above-description" should read --above description--;

COLUMN 20

Line 65, "$\theta_E=2\theta_E$ should read --$\theta=20_E$--;

COLUMN 21

Line 46, "12.50" should read --$^{M}12.5^{E\circ}$--

UNITED STATES PATENT AND TRADEMARK OFFICE

CERTIFICATE OF CORRECTION

PATENT NO. : 6,102,529

DATED : August 15, 2000

INVENTOR(S) : TAKESHI OKAZAKI ET AL.

It is certified that error appears in the above-identified patent and that said Letters Patent is hereby corrected as shown below:

COLUMN 27

Line 23, "be" shold be deleted;
Line 30, "accacy" should read --accuracy--;

COLUMN 34

Line 8, "$\theta_m$" should read --$\theta_M$--;

COLUMN 35

Line 51, "$\theta_m$" should read --$\theta_M$--;
Line 65, "7°)" should read --5°)--;

UNITED STATES PATENT AND TRADEMARK OFFICE

CERTIFICATE OF CORRECTION

PATENT NO. : 6,102,529

DATED : August 15, 2000

INVENTOR(S) : TAKESHI OKAZAKI ET AL.

It is certified that error appears in the above-identified patent and that said Letters Patent is hereby corrected as shown below:

COLUMN 37

Line 2, "reference" should read --a reference--;
Line 22, "5°)" should read --5°).--;
Line 43, "of" should be deleted;
Line 44, "wherein" should read --wherein by--;
Line 48, "of" should be deleted.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*